US006947700B2

(12) United States Patent
Kurotori et al.

(10) Patent No.: US 6,947,700 B2
(45) Date of Patent: Sep. 20, 2005

(54) FIXING APPARATUS AND IMAGE FORMING APPARATUS

(75) Inventors: Tsuneo Kurotori, Tokyo (JP); Eishu Ohdake, Tokyo (JP); Noriyasu Takeuchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/664,868

(22) Filed: Sep. 22, 2003

(65) Prior Publication Data

US 2004/0131402 A1 Jul. 8, 2004

(30) Foreign Application Priority Data

Sep. 20, 2002 (JP) ..... 2002-274602

(51) Int. Cl.[7] ..... G03G 15/20

(52) U.S. Cl. ..... 399/340; 399/320; 219/216; 430/97

(58) Field of Search ..... 399/320, 340, 399/67, 307, 339, 302, 308; 219/216; 430/97, 124; 347/156

(56) References Cited

U.S. PATENT DOCUMENTS

| | | | | |
|---|---|---|---|---|
| 5,263,698 A | | 11/1993 | Higuchi et al. | 270/58.05 |
| 5,289,203 A | | 2/1994 | Takeuchi | 347/206 |
| 5,333,042 A | * | 7/1994 | Brennan et al. | 399/320 |
| 5,402,220 A | | 3/1995 | Tanaka et al. | 399/68 |
| 5,463,447 A | | 10/1995 | Kurotori et al. | 399/1 |
| 5,521,679 A | | 5/1996 | Miyakawa et al. | 399/310 |
| 5,666,628 A | * | 9/1997 | Fukai | 399/340 |
| 5,678,158 A | | 10/1997 | Kurotori et al. | 399/390 |
| 5,708,938 A | | 1/1998 | Takeuchi et al. | 399/250 |
| 5,809,388 A | | 9/1998 | Inada et al. | 399/320 |
| 5,937,247 A | | 8/1999 | Takeuchi et al. | 399/237 |
| 5,987,281 A | | 11/1999 | Kurotori et al. | 399/237 |
| 5,999,779 A | | 12/1999 | Takeuchi | 399/239 |
| 6,038,421 A | | 3/2000 | Yoshino et al. | 399/239 |
| 6,108,508 A | | 8/2000 | Takeuchi et al. | 399/238 |
| 6,150,066 A | | 11/2000 | Kurotori et al. | 430/97 |
| 6,195,523 B1 | * | 2/2001 | Sakai | 399/307 X |
| 6,236,825 B1 | | 5/2001 | Takeuchi | 399/237 |
| 6,405,008 B1 | | 6/2002 | Obu et al. | 399/237 |
| 6,501,932 B2 | | 12/2002 | Obu et al. | 399/237 |
| 6,640,073 B2 | | 10/2003 | Kurotori et al. | 399/237 |

FOREIGN PATENT DOCUMENTS

| | | |
|---|---|---|
| JP | 8-72386 | 3/1996 |
| JP | 9-78039 | 3/1997 |
| JP | 3290513 B2 | 6/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

Since a fluorine treatment or the like is applied on a surface of an intermediate transfer belt (10), and thus, the surface bears water repelling property, when fixer (92) is supplied from a fixing apparatus (90) to surface parts of the intermediate transfer belt which are carrying a toner image, the fixer is present only on the toner parts. Namely, the fixer is not attached to surface parts which are not carrying the toner. Consequently, when the surface parts are pressed on transfer paper (P) for transferring and fixing, the fixer attached to the transfer paper is present only on the parts of the toner T. Thus, compared with a conventional case where fixer is imparted to entire transfer paper, a reduced quantity of the fixer is impregnated into the transfer paper, and thus, generation of curls and wrinkles of the transfer paper is restrained.

28 Claims, 14 Drawing Sheets

FIXING APPARATUS AND IMAGE FORMING APPARATUS

BACKGROUND OF THE INVENTION

1. Field of the Invention

The present invention relates to a fixing apparatus for imparting a fixer solving or swelling a toner to the toner, and then and for fixing the toner on a recording material, and to an image forming apparatus including the same fixing apparatus such as a copying machine, a facsimile, and a printer.

2. Description of the Prior Art

Conventionally, an image forming apparatus employing heat fixing method which heats and melts a toner on a recording material and then, presses the toner to fix it on the recording material is known. In this type of the image forming apparatus, a heating treatment at a fixing unit is responsible for 60% or more of power consumption. Thus, it is efficient to restrain the power consumption at the fixing unit as an energy saving measure for the overall image forming apparatus.

Conventionally, a various of fixing types which do not employ the heat fixing method have been proposed. Among them, a wet fixing method using a fixer for solving or swelling a toner for carrying out a fixing treatment is known. In this wet fixing method, the toner is fixed on a recording material by imparting the fixer to the toner for solving or swelling the toner. In this method, since heating treatment accompanying large electric power consumption such as that in the heat fixing method is eliminated, it can be said that this method is an excellent fixing method as an energy saving measure. Additionally, since a warm-up period as in the heat fixing method is not necessary, a quick start is possible. Image forming apparatuses employing the abovementioned wet fixing method include ones disclosed in Japanese Patent Publication No. 3290513, Japanese Patent Laid-Open Nos. H8-72386 and No. H9-78039, for example.

However, in the conventional wet fixing method, since the fixer is imparted to the entire surface of a recording material in a state where toner is attached, the fixer is also imparted to surface parts of the recording material on which the toner is not attached. Consequently, a large quantity of fixer is impregnated into the recording material, and thus, there is such a problem that the recording material tends to curl or wrinkle.

SUMMARY OF THE INVENTION

The present invention is made in view of the foregoing problems, and it is an object of the present invention to provide a fixing apparatus and an image forming apparatus which restrain generation of curls and wrinkles of a recording material even when the wet fixing method is employed as an energy saving measure.

To accomplish the object described above, the present invention has such a feature that, in a fixing apparatus which imparts fixer, which solves or swells toner, to toner, and then, fixes the toner on a recording material, a fixer supplying device which imparts the fixer such that the fixer is attached to the toner, and is not attached to surface parts of the recording material which are not carrying the toner is provided.

Also, the present invention has such a feature that an image forming apparatus includes a toner image carrying body, a transferring device for transferring toner on the toner image carrying body onto a recording material, a fixing device or fixing the toner image transferred onto the recording material, and a fixing apparatus for imparting fixer, which solves or swells toner, to the toner so as to fix the toner on the recording material, and the fixing apparatus includes a fixer supplying device which imparts the fixer such that the fixer is attached to the toner, and is not attached to surface parts of the recording material which are not carrying the toner.

Further, the present invention has such a feature that an image forming apparatus includes a toner image carrying body, a transferring device for transferring toner on the toner image carrying body onto a recording material, and a fixing device for fixing the toner image transferred onto the recording material, liquid repelling treatment is applied to the toner image carrying body such that a surface of the toner image carrying body bears a liquid repelling property against the fixer, and a fixer supplying device for supplying the fixer on the surface of the toner image carrying body carrying the toner image before the toner image on the toner image carrying body is transferred onto the recording material is provided.

With the features described above, it is possible to reduce the quantity of the fixer impregnated into the recording material compared with the conventional case where the fixer is imparted to the entire recording material.

As a method of imparting the fixer as in the present fixing apparatus and the present image forming apparatuses, there is a method of obtaining toner carrying positions on the surface of the toner image carrying body before the toner is transferred to the recording material, or on the surface of the recording material after the toner is transferred based on image information on an image to be formed, for example. By employing this method, it is possible to blow the fixer in an appropriate quantity only to the obtained toner carrying positions, and thus to impart the fixer to the toner without attaching the fixer to surface parts of the recording material which are not carrying the toner. In addition, as another method, for example, there is a method of imparting the fixer on the surface of the toner image carrying body in a state where a toner image is carried while liquid repelling treatment is applied to the surface of the toner image carrying body such that it bears a liquid repelling property in advance. With this method, the fixer imparted to the parts where the toner is not attached is in a state of being repelled from the surface of the toner image carrying body. Thus, it is possible to restrain the fixer from being attached to the parts where the toner is not attached before the surface of the toner image carrying body comes in contact with the recording material after the fixer is imparted. Additionally, even when the more or less fixer is attached to the parts where the toner is not attached, the fixer is attracted by toners around, and consequently, the fixer on those parts disappears. Thus, it is possible to impart the fixer to the toner without attaching the fixer to the surface parts of the recording material which are not carrying the toner.

DETAILED DESCRIPTION OF THE PREFERRED EMBODIMENTS

Embodiment 1

The following section describes one embodiment (the present embodiment is referred to as "embodiment 1" hereinafter) where the present invention is applied to a color copying machine of electrophotography type (simply referred to as "copying machine" hereinafter) as an image forming apparatus. In addition, the copying machine according to the present embodiment is a so-called tandem-type color image forming apparatus provided with an intermediate transfer belt which is a toner image carrying body.

Figure 2:
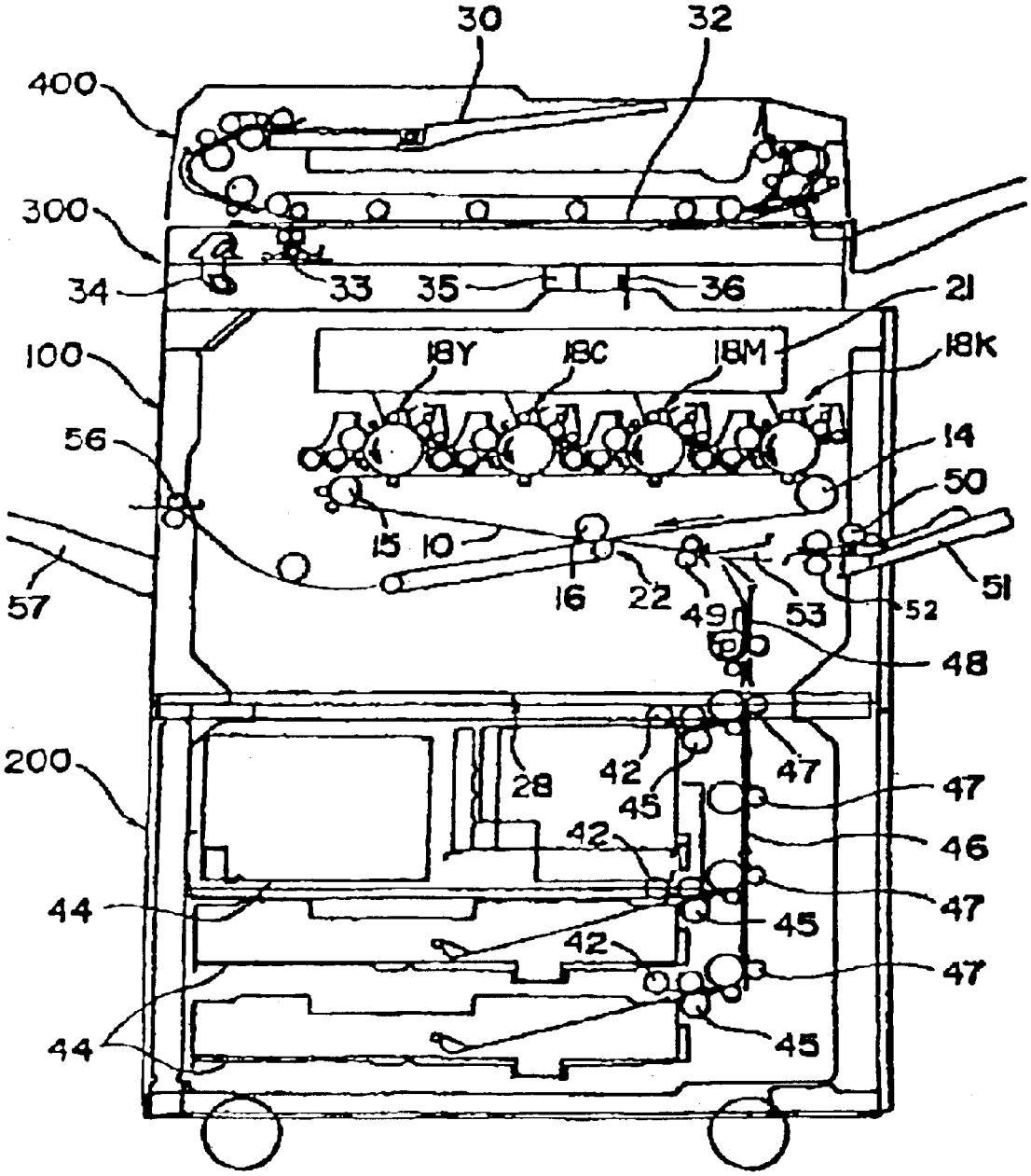
FIG. 2 is an overall schematic constitution diagram of the same copying machine.

FIG. 2 is a schematic constitution diagram of the entire copying machine according to the present embodiment. This copying machine is constituted by a copying machine main unit 100, a paper feeding table 200 for placing the copying machine main unit, a scanner 300 installed on the copying machine main unit, and an automatic document feeder (ADF) 400 installed on the top of the scanner.

Figure 3:
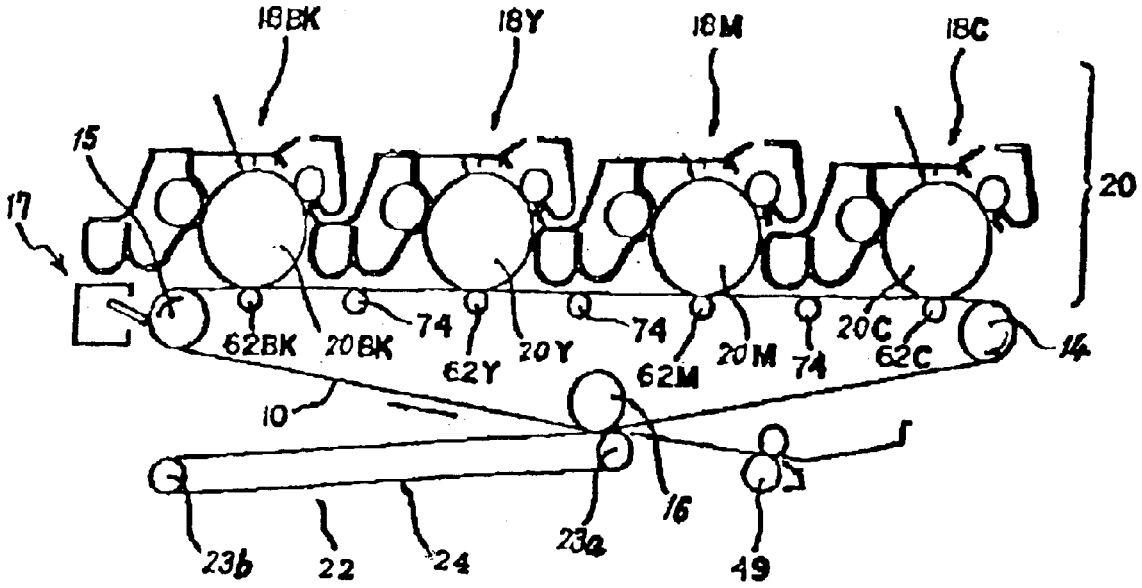
FIG. 3 is an enlarged view showing the constitution of a main unit of the same copying machine.

FIG. 3 is an enlarged view showing the constitution of a part of the copying machine main unit 100. An intermediate transfer belt 10 is provided as a toner image carrying body in the copying machine main unit 100. The intermediate transfer belt 10 is rotationally driven clockwise in FIG. 3 while the belt is stretched across support rollers 14, 15, and 16 which are three supporting members. Four image forming units 18Y, 18C, 18M, and 18BK for yellow, cyan, magenta, and black are disposed next to each other in a belt stretching part between the first support roller 14 and the second support roller 15 of the support rollers. An exposing apparatus 21 is provided above these image forming units 18Y, 18C, 18M, and 18BK as shown in FIG. 2. This exposing apparatus 21 is used to form a latent electrostatic image on the photoreceptor drums 20Y, 20C, 20M, and 20BK serving as latent image carrying bodies provided in the individual image forming units based on image information on a document read by the scanner 300. Additionally, a second transfer apparatus 22 is provided at a position opposing to the third support roller 16 of the support rollers. This second transfer apparatus 22 has a constitution where a second transfer belt 24 in an endless belt form, which is a transfer member serving as a surface traveling member, is stretched across two rollers 23*a* and 23*b*. Then, when the toner image on the intermediate transfer belt 10 is second-transferred on transfer paper serving as a recoding material, the second transfer belt 24 is pressed against a part of the intermediate transfer belt 10 wound on the third support roller 16 for conducting the second transfer. Note that the second transfer apparatus 22 may not be the constitution using the second transfer belt 24, but may be a constitution using a transfer roller, for example. Additionally, a belt cleaning apparatus 17 is provided at a position opposing to the second support roller 15 of the support rollers for the intermediate transfer belt 10. The belt cleaning apparatus 17 serves to remove the residual toner remaining on the intermediate transfer belt 10 after the toner image on the intermediate transfer belt 10 is transferred on the transfer paper.

Then, the constitution of the image forming units 18Y, 18C, 18M, and 18BK are described. In the following description, while the image forming unit 18BK forming a black toner image is exemplified, the other image forming units 18Y, 18C, and 18M have a similar constitution. Note that the image forming units 18Y, 18C, 18M, and 18BK may be constituted as a process cartridge including at least the photoreceptor drum 20, and constituting parts or constituting apparatuses constituting the image forming unit in part or as a whole. In this case, since the image forming units 18Y, 18C, 18M, and 18BK may be constituted detachably from the copying machine main unit 100, the maintainability increases.

Figure 4:
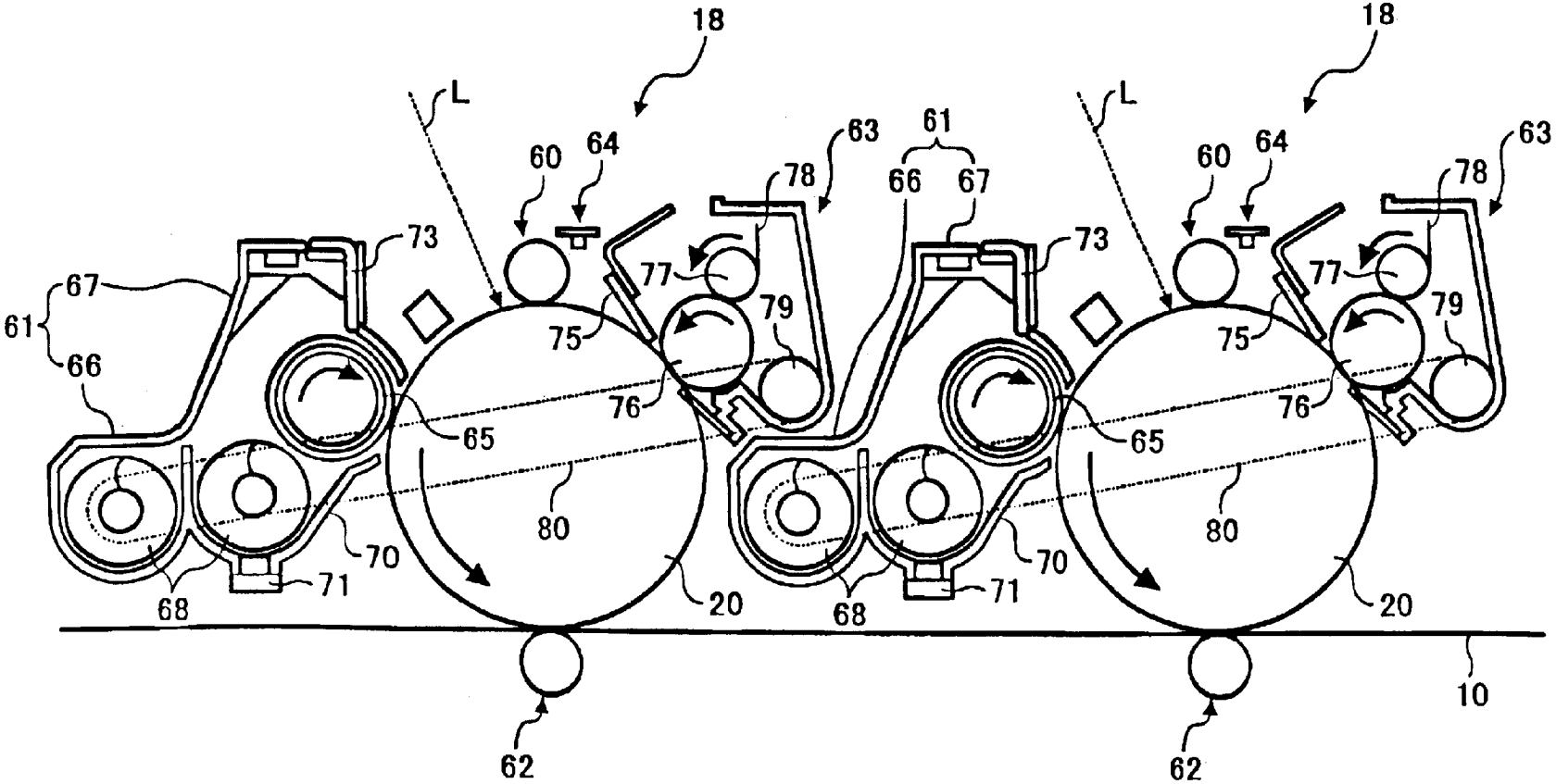
FIG. 4 is an enlarged view showing the constitution of two image forming units next to each other of the same copying machine.

FIG. 4 is an enlarged view showing the constitution of the two image forming units 18M and 18BK next to each other. Note that symbols "M" and "BK" indicating the distinction among colors are omitted in the numerals in this drawing, and these symbols are properly omitted in the following description.

The image forming unit 18 is provided with a charging apparatus 60, a developing apparatus 61, a photoreceptor cleaning apparatus 63, and a charge erasing apparatus 64 around the photoreceptor drum 20. A first transfer apparatus 62 is provided at a position opposing to the photoreceptor drum 20 through the intermediate transfer belt 10.

The charging apparatus 60 is a contact charging type apparatus employing a charging roller, and uniformly charges the surface of the photoreceptor drum 20 by coming in contact with the photoreceptor drum 20 and impressing a voltage. A non-contact charging type apparatus employing non-contact scorotron charge, for example, may be employed for this charging apparatus 60.

Additionally, while the developing apparatus 61 may use monocomponent developer, two-component developer including magnetic carrier and non-magnetic toner (simply referred to as "developer" hereinafter) is used in the present embodiment. Individual color toner used in the present embodiment includes a resin material colored into the individual color, and is formed with a material to be solved or swelled by fixer described later. This developing apparatus 61 is roughly divided into an agitating unit 66 and a developing unit 67. In the agitating unit 66, the developer is transported while being agitated, and is supplied on a developing sleeve 65 as a developer carrier. This agitating unit 66 is provided with two parallel screws 68, and a partition plate for partitioning such that these two screws 68 communicate with each other on the both ends is provided between the screws 68. Also, a toner density sensor 71 is installed for detecting the toner density in the developer in the developing apparatus in a developing case 70.

On the other hand, in the developing unit 67, the toner from the developer attached to the developing sleeve 65 is moved to the photoreceptor drum 20. In this developing unit 67, the developing sleeve 65 opposing to the photoreceptor drum 20 through an opening of the developing case 70 is provided, and an unillustrated magnet is fixed in the developing sleeve 65. Additionally, a doctor blade 73 is provided such that its tip is close to the developing sleeve 65.

In this developing apparatus 61, the developer is transported and circulated while being agitated by the two screws 68, and is supplied for the developing sleeve 65. The developer supplied for the developing sleeve 65 is drawn and held by the magnet. The developer drawn by the developing sleeve 65 is transported as the developing sleeve 65 rotates, and restricted to a proper quantity by the doctor blade 73. Note that the restricted developer is returned to the agitating unit 66. In this way, the developer transported to a developing area opposing to the photoreceptor drum 20 is clustered by the magnet, and forms a magnetic brush. In the developing area, a developing electric field which moves the toner in the developer to a latent electrostatic image part on the photoreceptor drum 20 is formed by a developing bias impressed on the developing sleeve 65. As a result, the toner in the developer is moved to the latent electrostatic image part on the photoreceptor drum 20, and the latent electrostatic image on the photoreceptor drum 20 is visualized to form a toner image. The developer after passing through the developing area leaves the developing sleeve 65 by being transported to a position where the magnetic force of the magnet is weak, and is returned to the agitating unit 66.

When the toner density in the agitating unit 66 decreases as a result of repeating this operation, the toner density sensor 71 detects this condition, and the toner is supplied for the agitating unit 66 based on the detection result.

Also, the first transfer apparatus 62 employs a first transfer roller, which is disposed to be pressed against the photoreceptor drum 20 with the intermediate transfer belt 10 between them. The first transfer apparatus 62 may not have a roller shape, and may employ a conductive brush shape or non-contact corona charge. In addition, a conductive roller 74 which contacts with the reverse surface, namely the inner peripheral surface side, of the intermediate transfer belt 10 is provided between the individual first transfer apparatuses 62. This conductive roller 74 prevents the bias impressed by the individual first transfer apparatus 62 in the first transfer from flowing into the next image forming unit through a layer on the inner peripheral surface side of the intermediate transfer belt 10.

Also, the photoreceptor cleaning apparatus 63 is provided with a cleaning blade 75 made of polyurethane rubber, for example, which is disposed such that the tip of it is pressed against the photoreceptor drum 20. Also, in the present embodiment, a conductive fur brush 76 in contact with the photoreceptor drum 20 is simultaneously used to increase the cleaning capability. A bias is impressed on the fur brush 76 from a metal electric field roller 77, and a tip of a scraper 78 is pressed against the electric field roller 77. Then, the toner removed from the photoreceptor drum 20 by the cleaning blade 75 and the fur brush 76 is stored inside the photoreceptor cleaning apparatus 63. Then, the toner is moved toward one side of the photoreceptor cleaning apparatus 63 by a collecting screw 79, is returned to the developing apparatus 61 through a toner recycling apparatus 80 described later, and is used again.

The charge erasing apparatus 64 is constituted by a charge erasing lamp, and the lamp radiates light to initialize the surface electric potential of the photoreceptor drum 20.

In the image forming unit 18 having the constitution described above, first the charging apparatus 60 uniformly charges the surface of the photoreceptor drum 20 as the photoreceptor drum 20 rotates. Then, based on the image information read by the scanner 300, the exposing apparatus 21 uses laser or an LED to radiate a write beam L, and forms the latent electrostatic image on the photoreceptor drum 20. Then, the exposing apparatus 61 visualizes the latent electrostatic image so as to form the toner image. This toner image is first transferred on the intermediate transfer belt 10 by the first transfer apparatus 62.

Transfer residual toner remaining on the surface of the photoreceptor drum 20 after the first transfer is removed by the photoreceptor cleaning apparatus 63, and then, the surface of the photoreceptor drum 20 is erased by the charge erasing apparatus 64, and is prepared for the next image forming.

Then, the operation of the copying machine of the present embodiment is described.

When the copying machine having the constitution described above is used for copying a document, first, the document is set on a document table 30 of the automatic document feeder 400. Otherwise, the automatic document feeder 400 is opened, the document is set on contact glass 32 of the scanner 300, and the automatic document feeder 400 is closed to press the document. Then, when a user presses an unillustrated start switch, the document is transported on the contact glass 32 when the document was set in the automatic document feeder 400. Then, the scanner 300 drives to start traveling the first traveling body 33 and a second traveling body 34. As a result, light from the first traveling body 33 reflects on the document on the contact glass 32, the reflected light is reflected on the second traveling body 34, and is guided to a reading sensor 36 through an image focusing lens 35. In this way, image information on the document is read.

In addition, when the user presses the start switch, an unillustrated drive motor starts driving, and one of the support rollers 14, 15, and 16 is rotationally driven to rotationally drive the intermediate transfer belt 10. Also, simultaneously, the photoreceptor drums 20Y, 20C, 20M, and 20BK of the individual image forming units 18Y, 18C, 18M, and 18BK, and the second transfer belt 24 of the second transfer apparatus 22 are also rotationally driven.

Note that synchronizing control described later is applied to the intermediate transfer belt 10, the photoreceptor drums 20Y, 20C, 20M, and 20BK, and the second transfer belt 24 such that constant relative speeds among them are maintained.

Then, based on the image information read by the reading sensor 36 of the scanner 300, the exposing apparatus 21 radiates the write beam L respectively on the photoreceptor drums 20Y, 20C, 20M, and 20BK of the individual image forming units. As a result, the latent electrostatic image is formed respectively on the individual photoreceptor drums 20Y, 20C, 20M, and 20BK, and is visualized by the developing apparatuses 61Y, 61C, 61M, and 61BK. Then, the toner images in yellow, cyan, magenta, and black are formed respectively on the individual photoreceptor drums 20Y, 20C, 20M, and 20BK. The toner images in the individual colors formed in this way are sequentially and respectively first-transferred on the intermediate transfer belt 10 such that they overlap one another by the individual first transfer apparatuses 62Y, 62C, 62M, and 62BK. As a result, a composite toner image which is the overlapped toner images in the individual colors is formed on the intermediate transfer belt 10. Note that the transfer residual toner remaining on the intermediate transfer belt 10 after the second transfer is removed by means of the belt cleaning apparatus 17.

Additionally, when the user presses the start switch, a paper feeding roller 42 of the paper feeding table 200 corresponding to the transfer paper selected by the user rotates, and the transfer paper is sent out from one of paper feeding cassettes 44. The sent-out transfer paper is separated into one sheet by separating rollers 45, enters into a paper feeding path 46, and is transported to a paper feeding path 48 inside the copying machine 100 by transporting rollers 47. The transfer paper transported in this way stops when it abuts on resist rollers 49.

Note that when transfer paper which is not set in the paper feeding cassette 44 is used, the transfer paper set in a manual feeding tray 51 is sent out by a paper feeding roller 50, is separated into one sheet by separating rollers 52, and then, is transported through a manual paper feeding path 53. Then, similarly, the transfer paper stops when it abuts on the resist rollers 49.

The resist rollers 49 start rotation in sync with timing when the composite toner image formed on the intermediate transfer belt 10 as described above is transported to the second transfer unit opposing to the second transfer belt 24 of the second transfer apparatus 22. In this state, though generally the resist rollers 49 are often used while they are grounded, a bias may be impressed so as to remove paper powder of the transfer paper. While a DC voltage is used as the impressed bias, an AC voltage having a DC offset component may be used so as to more uniformly charge the transfer paper. Note that the surface of the transfer paper after passing through the resist rollers 49 on which the bias is impressed is negatively charged slightly. Thus, in this case, in the second transfer from the intermediate transfer belt 10 to the transfer paper, since the transfer condition is different from that for transfer paper for which the bias is not impressed on the resist rollers 49, it is necessary to properly change the transfer condition.

The transfer paper sent out from the resistor rollers 49 is sent into a second transfer nip formed between the intermediate transfer belt 10 and the second transfer belt 24, and the second transfer apparatus 22 second-transfers the composite toner image on the intermediate transfer belt 10 on the transfer paper. In this process, in the present embodiment, fixer is imparted on the composite toner image on the intermediate transfer belt 10 as described later before the second transfer. Then, by pressing the composite toner image to which the fixer is imparted against the transfer paper in the second transfer nip, the composite toner image is second-transferred on the transfer paper, and simultaneously, is fixed on the transfer paper. Then, the transfer paper is transported to paper ejecting rollers 66 while sucked to the second transfer belt 24, and is ejected and stacked in an ejected paper tray 57.

The following section describes a fixing process which is a characteristic part of the present invention.

Figure 1:
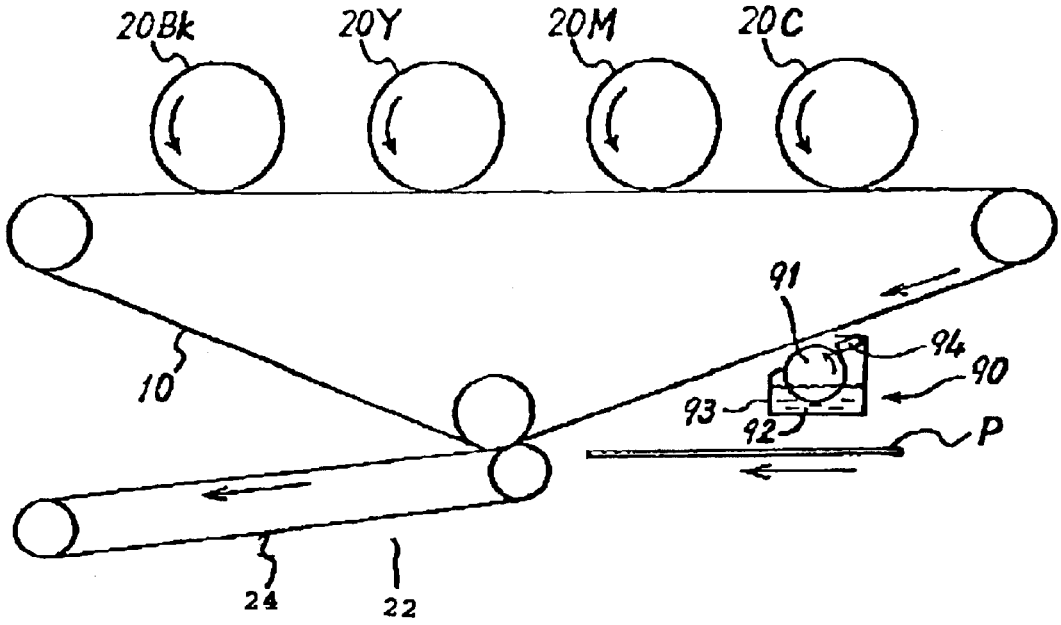
FIG. 1 is a schematic constitution diagram of a part including a fixing apparatus in a copying machine according to an embodiment 1.

FIG. 1 is a schematic constitution diagram of a part including the fixing apparatus as a fixing device of the copying machine according to the present embodiment 1.

In the copying machine according to the present embodiment 1, a fixing apparatus 90 is disposed on the upstream side of the second transfer unit in the surface traveling direction of the intermediate transfer belt 10. This fixing apparatus 90 is provided with a supplying roller 91 as a fixer supplying device disposed in separation by a slight gap from and opposing to the surface of the intermediate transfer belt 10. The fixing apparatus 90 has a constitution moved by an unillustrated drive mechanism so as to make the supplying roller 91 approach to or depart from the surface of the intermediate transfer belt 10. Additionally, the fixer 92 is contained inside a fixer tank 93 of the fixing apparatus 90, and the supplying roller 91 is disposed while it is immersed in the fixer 92. The supplying roller 91 is rotationally driven in a direction indicated by an arrow in the drawing when the fixer 92 is imparted to the toner. As a result, the fixer 92 is drawn on the surface of the supplying roller 91. The fixer 92 drawn as described above is restricted by means of a metering blade 94, and thus, the fixer attached to the surface of the supplying roller 91 is properly regulated. Then, the fixer on the supplying roller 91 is transported to the position opposing to the surface of the intermediate transfer belt 10 as the supplying roller 91 rotates, and the fixer is supplied on the surface of the intermediate transfer belt 10.

The fixer 92 used in the present embodiment is liquid comprising a material which solves or swells the resin component constituting the toner (referred to as "solving/swelling component" hereinafter), and water. This solving/swelling component is preferably a material having affinity to water. Specific examples of this solving/swelling component include higher glycol ether, ethylene glycol monoether, diethylene glycol monoether, ethylene glycol, monomethyl ether=2-methoxyethanol, diethylene glycol, diethylene glycol monoethyl ether, propylene glycol monomethyl ether, ethylene glycol, butylcellosolve ethyl carbitol, aliphatic dibasic acid ester, DBE (dibasic acid ester), ester high boiling admixture, straight-chain dibasic acid ester (maleic ester), itaconic acid ester, trimellitic ester, and dibasic acid ester.

A surface active agent may be used for dissipating the solving/swelling component in water. Specific examples of this surface active agent include negative ion (anion) surface active agent such as fatty acid derivative sulfuric ester, sulfonic acid type, and phosphoric ester, positive ion (cation) surface active agent such as quaternary ammonium salt, heterocyclic amine, and amine derivative, amphoteric ion (nonion) surface active agent such as amino acid ester, amino acid, and sulfobetaine, and a nonionic surface active agent, polyoxyalkylene alkyl ether, and polyoxyethylene alkyl amine.

In the present embodiment, liquid which is formed by mixing the solving/swelling component and the surface active agent with water at a density of 20% or less is used as the fixer 92.

In addition, since fluorine treatment or the like is applied on the surface of the intermediate transfer belt 10 as liquid repelling treatment according to the present embodiment, the surface bears water repelling property consequently. It is preferable to apply this treatment such that the contact angle with respect to water is 60° or more. When the fixer 92 on the supplying roller 91 comes in contact with the surface of the intermediate transfer belt 10 to which this water repelling treatment is applied, the fixer 92 remains on the supplying roller 91 without being attached to the surface of the intermediate transfer belt 10. Namely, even if the fixer 92 is supplied on the surface of the intermediate transfer belt 10, the fixer 92 is hardly attached to the surface of the intermediate transfer belt 10.

The following section describes the flow of the fixing process in the present embodiment 1.

When the toner image in the individual colors overlap one another on the intermediate transfer belt 10 to form the composite toner image, the composite toner image is transported to the position opposing to the supplying roller 91 of the fixing apparatus 90 as the surface of the intermediate transfer belt 10 travels. The fixing apparatus 90 stands by while it is separated from the intermediate transfer belt 10 until the composite toner image reaches as a result of the transportation. Then, the fixing apparatus 90 is moved to a position where the supplying roller 91 is close to the surface of the intermediate transfer belt 10 by the drive mechanism just before the leading end of the composite toner image reaches the position opposing to the supplying roller 91. As a result, the fixer 92 on the supplying roller 91 is supplied on the surface of the intermediate transfer belt 10.

FIG. 5A through FIG. 5D are descriptive drawings showing a chronological state change in the toner T carried by the surface of the intermediate transfer belt 10 and the fixer 92 imparted to the toner.

Figure 5A:
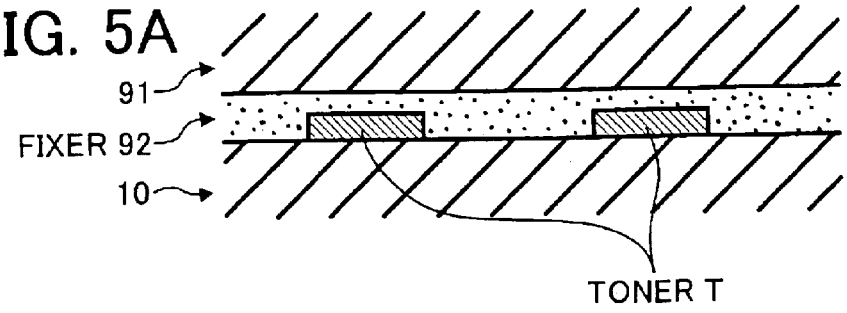
FIGS. 5A through D are descriptive drawings showing a chronological state change in toner carried by a surface of an intermediate transfer belt and fixer imparted to the toner.
Figure 5B:
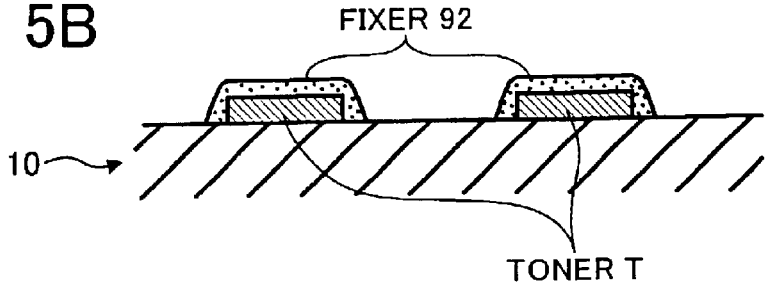

FIG. 5A shows a state of the toner T and the fixer 92 on the intermediate transfer belt 10 at the opposing position (liquid supplying position) where the intermediate transfer belt 10 and the supplying roller 91 oppose to each other. At this liquid supplying position, the fixer 92 fills between the intermediate transfer belt 10 and the supplying roller 91, and the fixer 92 comes in contact with the intermediate transfer belt 10 whether the toner is attached or not. Then, when the surface part of the intermediate transfer belt 10 shown in FIG. 5A passes through the liquid supplying position, it reaches the state shown in FIG. 5B. Namely, since the water repelling treatment is applied to the surface of the intermediate transfer belt 10 which is not carrying the toner T, it repels the fixer 92 which has water as the main component. As a result, the fixer 92 in contact with the surface parts is not attached to the surface parts, and is collected inside the fixing apparatus 90 while it remains attached on the supplying roller 91. On the other hand, the fixer 92 in contact with the toner T carried on the surface of the intermediate transfer belt 10 is not attached on the supplying roller 91, but is attached to the toner T. Thus, a state where the fixer 92 is attached to the parts carrying the toner T, and the fixer 92 is not attached to the surface parts without carrying the toner T arises on the intermediate transfer belt 10 after passing through the liquid supplying position.

Figure 5C:
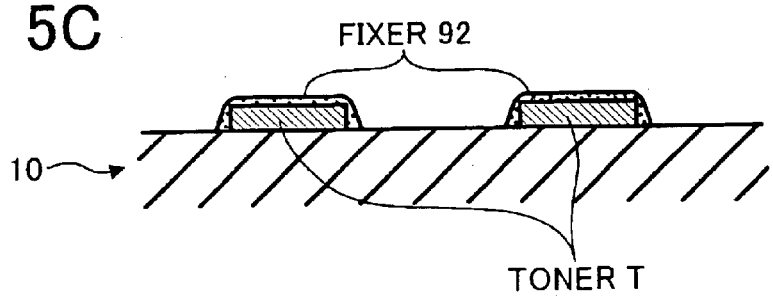
Figure 5D:
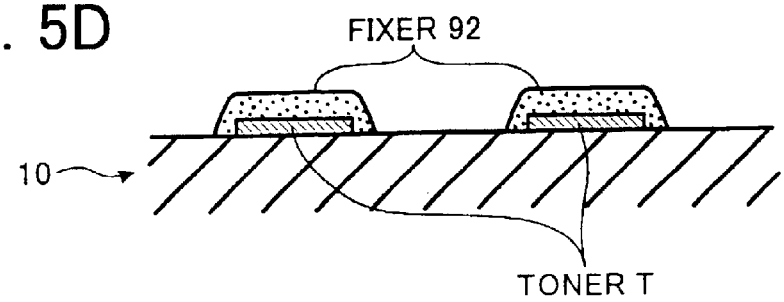

When the fixer 92 is imparted to the toner T in this way, the resin component of the toner T reacts with the solving/swelling component of the fixer 92. Consequently, the toner T swells and solves as shown in FIG. 5C. Then, the toner T reaches a state where the toner T presents viscosity, discharges excess of the fixer 92, which is impregnated inside during the swelling, on the surface, and changes into a film state as shown in FIG. 5D. The toner T which has changed into the film state in this way is transported to the second transfer unit where the nip is formed by the intermediate transfer belt 10 and the second transfer belt 24 of the second transfer apparatus 22 as the surface of the intermediate transfer belt 10 travels.

Then, in this second transfer unit, the toner T on the intermediate transfer belt 10 is pressed against the surface of the transfer paper P, thereby being transferred on the transfer paper P by its viscosity, and simultaneously being fixed.

As described above, with the present embodiment 1, the fixer 92 on the surface of the intermediate transfer belt 10 is present only on the parts of the toner T. As a result, when transferring and fixing is conducted by pressing the surface of the intermediate transfer belt 10 against the transfer paper P, the fixer 92 attached to the transfer paper P exists only on the toner T parts. Thus, compared with a conventional case where fixer is imparted to entire transfer paper, a reduced quantity of the fixer 92 is impregnated into the transfer paper P, and thus, generation of curls and wrinkles of the transfer paper P is restrained.

In addition, with the present embodiment 1, compared with the conventional case, since the fixer 92 consumed per sheet of the transfer paper is reduced, advantage of restraining the wasteful consumption of the fixer 92 also arises.

Further, as a result of the reduced fixer 92 attached on the transfer paper P, it is possible to realize a constitution where a mechanism which forcibly dries the fixer 92 is not provided as the present embodiment 1. Thus, the electric power consumed by the conventional forcibly-drying mechanism can be eliminated, and the energy saving is realized.

CONSTITUTION EXAMPLE 1

The following section describes another constitution example (referred to as "constitution example 1" hereinafter) of the fixing apparatus according to the embodiment 1.

Figure 6:
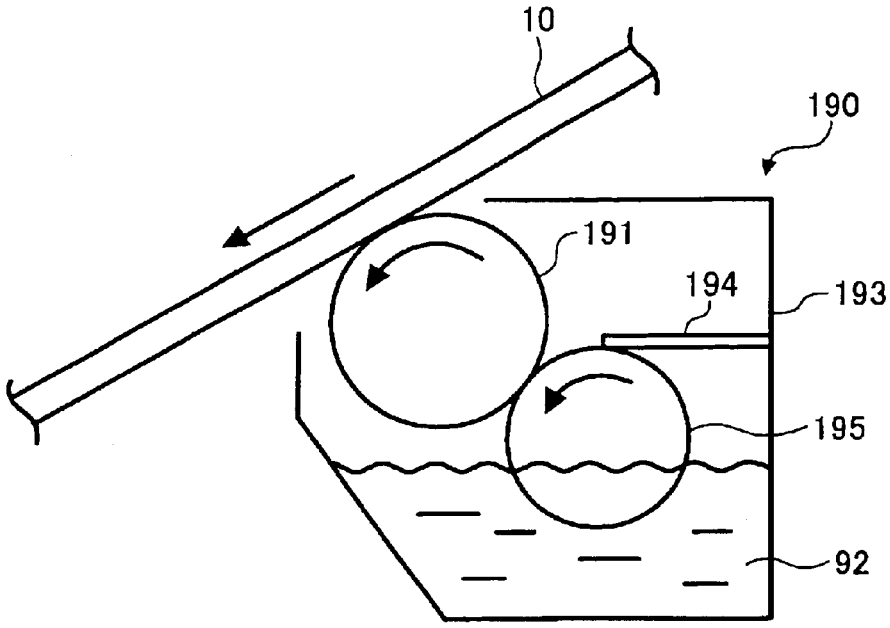
FIG. 6 is a schematic constitution diagram showing a fixing apparatus according to a constitution example 1.

FIG. 6 is a schematic construction diagram showing a fixing apparatus 190 of the present constitution example 1. This fixing apparatus 190 is common to the fixing apparatus 90 of the embodiment 1 in terms that a supplying roller 191 supplies the surface of the intermediate transfer belt 10 with the fixer 92. However, in the fixing apparatus 190 of the present constitution example 1, how to measure the quantity of the fixer attached on the surface of the supplying roller 191 is different from that in the embodiment 1. Namely, while, in the embodiment 1, the metering blade 94 measures the fixer quantity on the supplying roller 91, an applying roller 195 measures the quantity in the present constitution example 1.

Figure 7:
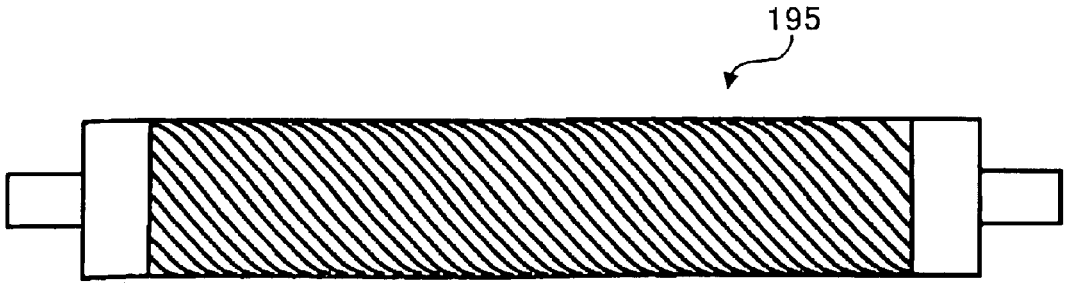
FIG. 7 is a front view showing an applying roller of the same fixing apparatus.

FIG. 7 is a front view showing the applying roller 195. As shown in the drawing, fine grooves in a uniform pattern are formed on the surface of the applying roller 195. The applying roller 195 is disposed such that it is in contact with the surface of the supplying roller 191 while it is immersed in the fixer 92 in a fixer tank 193. The applying roller 195 is rotationally driven in a direction indicated by an arrow in the drawing when the fixer 92 is imparted to the toner. As a result, the fixer 92 is drawn on the surface of the applying roller 195. The fixer 92 drawn in this way is carried while it is inside the grooves on the surface of the applying roller 195, and the fixer 92 attached to the outside of the grooves is scraped off by a scraping blade 194. Then, the fixer 92 on the applying roller 195 is transported to the contact position with the supplying roller 191 as the applying roller 195 rotates. At this contact position, the surfaces of the supplying roller 191 and the applying roller 195 travel in opposite rotation directions, and the fixer 92 inside the grooves of the applying roller 195 is attached to the surface of the supplying roller 191. Thus, by adjusting the inner volume of the grooves disposed on the surface of the applying roller 195, it is possible to adjust the fixer on the supplying roller 191 to a proper quantity.

Note that while the grooves formed on the surface of the applying roller 195 are a large number of groves extending in a spiral shape as shown in FIG. 7 in the present constitution example 1, they may be grooves constituted in other patterns. For example, a groove pattern where a large number of holes in an inverse cone shape or an inverse pyramid shape are uniformly arranged on the applying roller 195 may be employed.

As described above, with the present constitution example 1, it is possible to use the grooves formed on the applying roller 195 for uniformly applying the fixer 92 on the order of micrometers in layer thickness on the surface of the supplying roller 191. Thus, it is possible to bring the very thin layer of the fixer 92 in contact with the surface of the intermediate transfer belt 10, and thus to restrain the liquid quantity of the fixer 92 supplied on the surface of the intermediate transfer belt 10 to a small quantity. Consequently, it is possible to further reduce the quantity of the fixer 92 impregnated into the transfer paper P, and to further restrain the generation of the curls and the wrinkles of the transfer paper P. Additionally, it is possible to further restrain the wasteful consumption of the fixer 92.

CONSTITUTION EXAMPLE 2

The following section describes another constitution example (referred to as "constitution example 2" hereinafter) of the fixing apparatus according to the embodiment 1.

Figure 8:
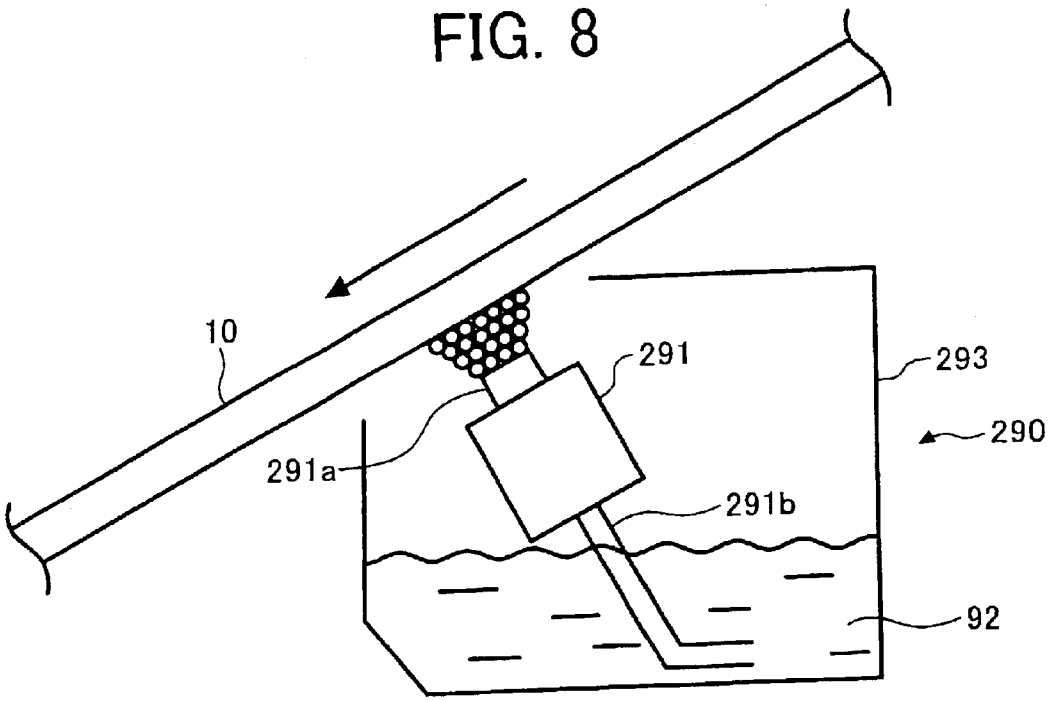
FIG. 8 is a schematic constitution diagram showing a fixing apparatus according to a constitution example 2.

FIG. 8 is a schematic constitution diagram showing a fixing apparatus 290 of the constitution example 2. This fixing apparatus 290 is different from the embodiment 1 and the constitution example 1 in how to supply the fixer 92 on the surface of the intermediate transfer belt 10. Namely, in the constitution example 2, the fixer 92 is foamed, and then, is supplied on the surface of the intermediate transfer belt 10. Different methods may be used to foam the fixer 92. For example, there is such a method that the fixer 92 containing the surface active agent is foamed by supplying compressed air from a compressor. As a method for generating finer foam, there is such a method that the fixer 92 is blown through a porous filter having holes with a minute diameter such as ceramics or a material in a sponge state.

In the present constitution example 2, a head 291*a* of a nozzle 291 as the fixer supplying device opens along the crosswise direction of the intermediate transfer belt 10, and a porous filter is disposed inside the head 291*a*. Then, the fixer 92 in a fixer tank 293 is drawn from a suction pipe 291*b* of the nozzle 291 by an unillustrated pump. The drawn fixer 92 is blown from the head 291*a* through the nozzle 291. The blown fixer 92 foams during passing through the porous filter, and is supplied on the surface of the intermediate transfer belt 10. Note that while the head 291*a* extending in the crosswise direction of the intermediate transfer belt 10 is employed in the present constitution example 2, such a constitution that a head with a narrow width may reciprocate along the crosswise direction of the intermediate transfer belt 10 may be employed.

Note that the fixer 92 may contain surface active agent for efficiently foam the fixer 92. In this case, it is preferable that the ratio of the contained surface active agent is 20% or less. As long as within this range, study of the present inventors has confirmed that the contained surface active agent does not change the property of fixing the toner T.

As described above, with the present constitution example 2, by supplying the foamed fixer 92, it is possible to supply the fixer 92 in a small liquid quantity to a wide area. In this case, the foamed fixer 92 may also be attached to the surface parts of the intermediate transfer belt 10 which are not carrying the toner T. However, since the fixer 92 is in the state where it can be easily moved due to the water repelling effect of the intermediate transfer belt 10, the fixer 92 is finally combined with the fixer 92 attached to the toner T around by receiving effects of vibration applied to the intermediate transfer belt 10 and gravity. Then, most of the fixer is removed from the surface parts of the intermediate transfer belt 10 which are not carrying the toner T before these parts reach the second transfer unit. Thus, it is possible to restrain the liquid quantity of the fixer 92 supplied on the surface of the intermediate transfer belt 10 to a small quantity. Consequently, it is possible to further reduce the quantity of the fixer 92 impregnated into the transfer paper P, and to further restrain the generation of the curls and the wrinkles of the transfer paper P. Additionally, it is possible to further restrain the wasteful consumption of the fixer 92.

CONSTITUTION EXAMPLE 3

The following section describes another constitution example (referred to as "constitution example 3" hereinafter) of the fixing apparatus according to the embodiment 1.

Figure 9:
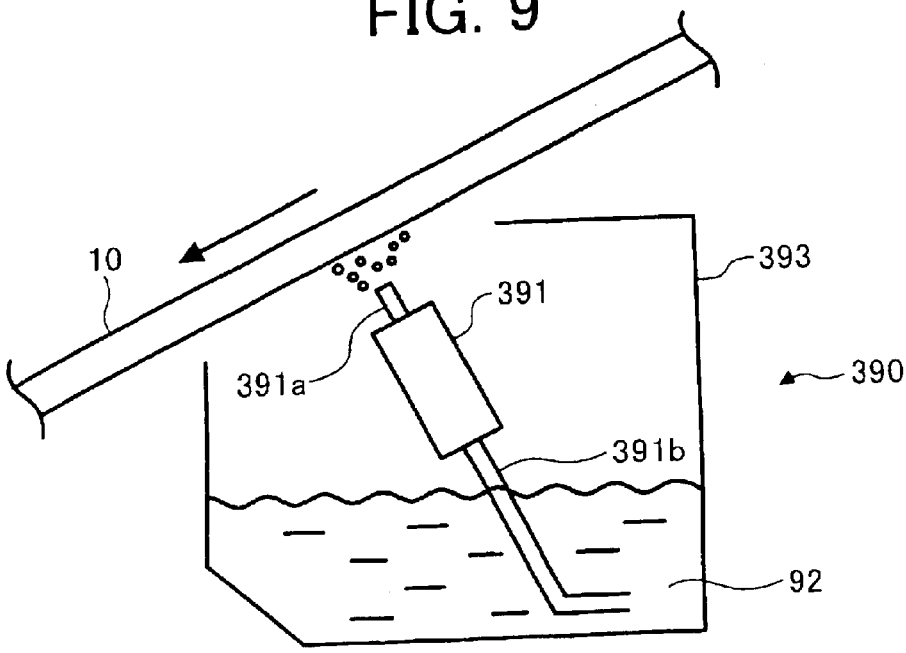
FIG. 9 is a schematic constitution diagram showing a fixing apparatus according to a constitution example 3.

FIG. 9 is a schematic constitution diagram showing a fixing apparatus 390 of the constitution example 3. This fixing apparatus 390 is different from the embodiment 1, the constitution example 1, and the constitution example 2 in how to supply the fixer 92 on the surface of the intermediate transfer belt 10. Namely, in the constitution example 3, the fixer 92 is atomized, and then, is supplied on the surface of the intermediate transfer belt 10. Different methods may be used to atomize the fixer 92. For example, there is such a method that compressed air is supplied for the fixer 92 from a compressor through a nozzle to blow it into an atomized state, which is a so-called spray method.

In the present constitution example 3, a head 391*a* of a nozzle 391 as the fixer supplying device opens along the crosswise direction of the intermediate transfer belt 10. Then, the fixer 92 in the fixer tank 393 is drawn from a suction pipe 391*b* of the nozzle 391 by an unillustrated pump. The drawn fixer 92 is blown in the atomized state from the head 391*a* through the nozzle 391, and is supplied on the surface of the intermediate transfer belt 10. Note that while the head 391*a* extending in the crosswise direction of the intermediate transfer belt 10 is employed in the present constitution example 3, such a constitution that a head 391*a* with a narrow width may reciprocate along the crosswise direction of the intermediate transfer belt 10 may be employed.

As described above, with the present constitution example 3, by supplying the atomized fixer 92, it is possible to supply the fixer 92 in a small liquid quantity to a wide area. In this case, the atomized fixer 92 may also be attached to surface parts of the intermediate transfer belt 10 which are not carrying the toner T. However, most of the fixer is removed from the surface parts before these parts reach the second transfer unit as in the constitution example 2. Thus, it is possible to restrain the liquid quantity of the fixer 92 supplied on the surface of the intermediate transfer belt 10 to a small quantity. Consequently, it is possible to further reduce the quantity of the fixer 92 impregnated into the transfer paper P, and to further restrain the generation of the curls and the wrinkles of the transfer paper P. Additionally, it is possible to further restrain the wasteful consumption of the fixer 92.

CONSTITUTION EXAMPLE 4

The following section describes another constitution example (referred to as "constitution example 4" hereinafter) of the fixing apparatus according to the embodiment 1.

After the toner T to which the fixer 92 is attached on the intermediate transfer belt 10 is swelled as shown in FIG. 5C, the toner T discharges excess of the fixer 92 impregnated inside on its surface, and changes into the film state in FIG. 5D. The fixer 92 left after the change into the film state is excess which no longer contributes to the fixing. Even if the fixer 92 is left as it is, and is attached to the transfer paper P, since the attached quantity is smaller than that in the conventional case, the degree of the curls or the wrinkles of the transfer paper P is small. However, it is preferable to actively remove the fixer 92, which is no longer necessary, to further restrain the curls and the wrinkles of the transfer paper P.

In addition, when an image having a high ratio of the image area is formed on the transfer paper P the ratio occupied by the toner T is also high on the transfer paper P, and the quantity of the fixer 92 attached to the transfer paper P increases proportionately. In this case, when the quantity of the fixer 92 supplied by the fixing apparatuses 90, 190, 290, and 390 to the intermediate transfer belt 10 is excessive, the degree of the curls and the wrinkles of the transfer paper P may exceeds a practical range. Thus, it is preferable to actively remove the fixer 92, which is no longer necessary, from this point of view.

Thus, in the present constitution example 4, a specific example where a mechanism for removing the excess is added is described.

Figure 10:
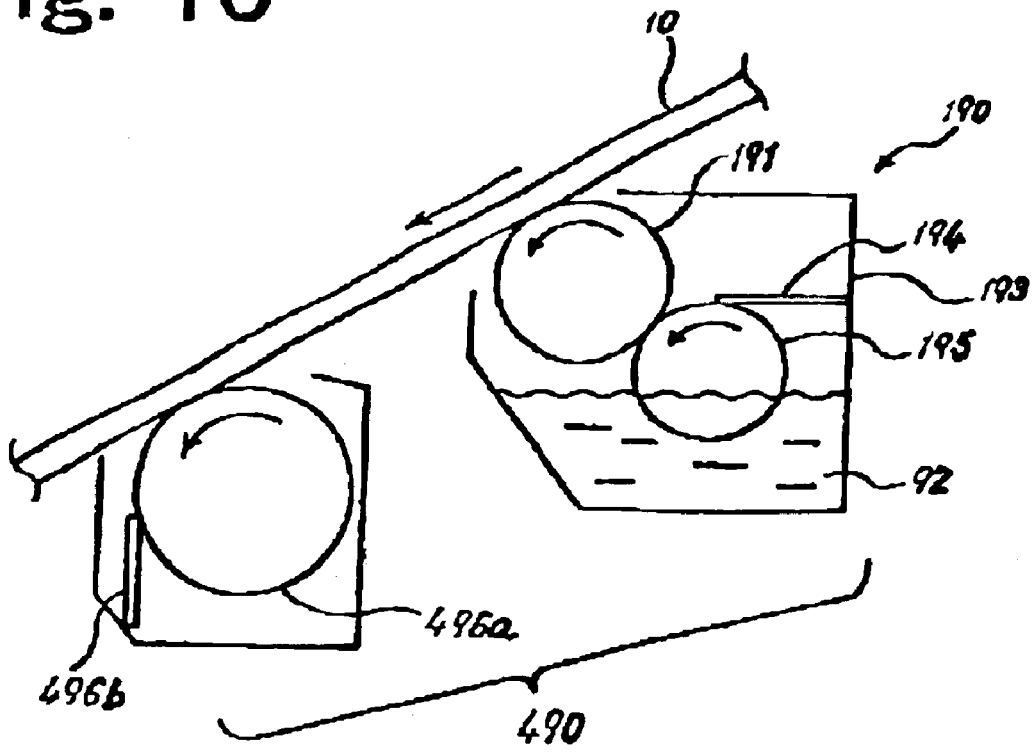
FIG. 10 is a schematic constitution diagram showing a fixing apparatus according to a constitution example 4.

FIG. 10 is a schematic constitution diagram showing a fixing apparatus 490 of the present constitution example 4. The main unit of the fixing apparatus 490 has a constitution similar to the fixing apparatus 190 in the constitution example 1 shown in FIG. 6. However, this fixing apparatus 490 is provided with an excessive liquid collecting roller 496*a* as an excessive liquid removing device, which is different from the embodiment 1, the constitution example 1, the constitution example 2, and the constitution example 3. This excessive liquid collecting roller 496*a* is disposed such that it is in contact with the surface of the intermediate transfer belt 10 between the liquid supplying position and the second transfer unit. This excessive liquid collecting roller 496*a* is constituted such that it is rotationally driven at the same linear velocity and simultaneously in the same direction as the surface of the intermediate transfer belt 10 at its contact position. A metal roller to which anodizing or the like is applied is preferable as this excessive liquid collecting roller 496*a*. Also, though the roller may by a roller made of rubber, in this case, it is preferable that the surface is formed with an oil repelling material such as silicon rubber so that the viscous toner T is hardly attached.

In the present constitution example 4, when the surface parts of the intermediate transfer belt 10 carrying the fixer 92 and the toner T reach the contact position with the excessive liquid collecting roller 496*a*, the unnecessary fixer 92 is held between the intermediate transfer belt 10 and the excessive liquid collecting roller 496*a*. Then, when the surface part of the intermediate transfer belt 10 passes the contact position, the fixer 92 on the intermediate transfer belt 10 is attached to the front side of the excessive liquid collecting roller 496*a*. As a result, the fixer 92, which is no longer necessary, is collected by the excessive liquid collecting roller 496*a*, and is removed from the surface of the intermediate transfer belt 10. Note that the fixer 92 collected by the excessive liquid collecting roller 496*a* is scraped by a cleaning blade 496*b*.

As described above, with the present constitution example 4, the fixer 92 which is no longer necessary for the fixing can be removed before the toner T on the intermediate transfer belt 10 is second-transferred on the transfer paper P. As a result, it is possible to restrain the quantity of the fixer 92 attached to the transfer paper P to a further smaller quantity. Consequently, it is possible to further reduce the quantity of the fixer 92 impregnated into the transfer paper P, and to further restrain the generation of the curls and the wrinkles of the transfer paper P.

In addition, though the water repelling treatment is applied on the surface of the intermediate transfer belt 10 as described above, the water repelling effect may decrease as time elapses. If this is the case, the fixer 92 may be slightly attached as droplets to the surface parts of the intermediate transfer belt 10 which are not carrying the toner. However, with the present constitution example 4, the fixer 92 in the droplet state can be collected by means of the excessive liquid collecting roller 496*a* in the same way. Thus, with the present constitution example 4, it is possible to efficiently restrain the curls and the wrinkles of the transfer paper P which may occur due to the secular degradation of the water repelling property of the intermediate transfer belt 10.

Note that though the excessive liquid collecting roller 496*a* is brought in contact with the surface of the intermediate transfer belt 10 to collect the unnecessary fixer 92 in the present constitution example 4, other constitutions using this excessive liquid collecting roller 496*a* may be employed. For example, the excessive liquid collecting roller 496*a* is disposed with a slight gap to the surface of the intermediate transfer belt 10, and is rotationally driven such that the surface of the excessive liquid collecting roller 496*a* moves in the opposite direction with respect to the surface of the intermediate transfer belt 10 at the opposing position. With this constitution, the excessive liquid collecting roller 496*a* can serve as a so-called squeezing roller. As a result, when the fixer 92 on the intermediate transfer belt 10 passes through the slight gap, the fixer 92 is squeezed by the surface of the excessive liquid collecting roller 496*a*, and is collected. With this constitution, it is possible to reduce an external force applied to the toner T when the fixer is removed compared with the case where the excessive liquid collecting roller 496*a* is brought in contact with to collect the fixer. Thus, when the fixer 92 is removed, it is possible to restrain the toner image formed by the toner T carried on the intermediate transfer belt 10 from being disturbed.

CONSTITUTION EXAMPLE 5

The following section describes another constitution example (referred to as "constitution example 5" hereinafter) of the fixing apparatus according to the embodiment 1.

Figure 11:
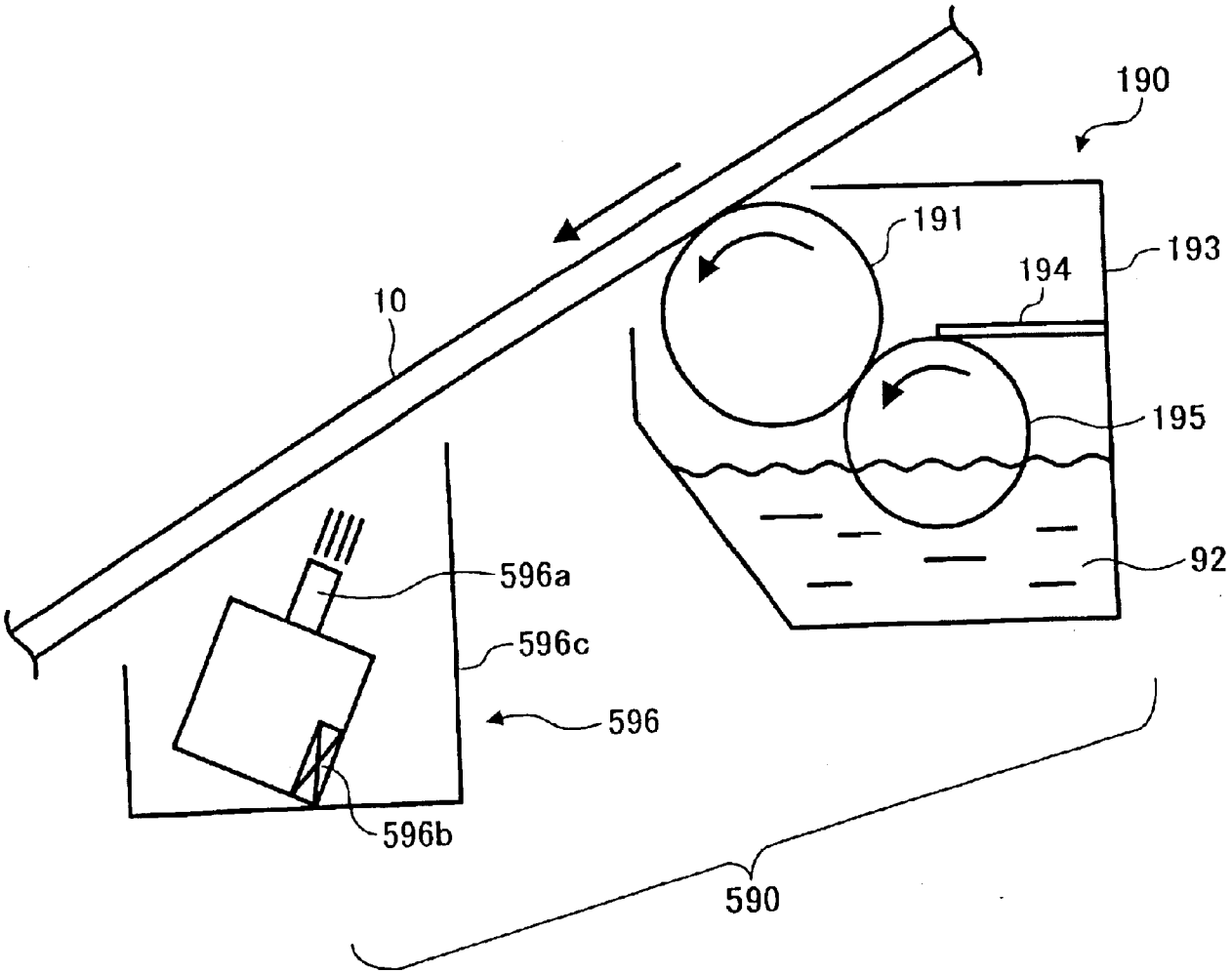
FIG. 11 is a schematic constitution diagram showing a fixing apparatus according to a constitution example 5.

FIG. 11 is a schematic constitution diagram showing a fixing apparatus 590 of the present constitution example 5. This fixing apparatus 590, as in the case with the constitution example 4, has the same constitution of the main unit as the fixing apparatus 190 according to the constitution example 1 shown in FIG. 6, and is also provided with the excessive liquid removing device. However, the present constitution example 5 is different from the constitution example 4 in that the excessive liquid removing device is an air knife 596.

In the fixing apparatus 590 according to the present constitution example 5, the air knife 596 is disposed at the same position as the excessive liquid collecting roller 496*a* in the constitution example 4. The air knife 596 is provided with an air blowing out opening 596*a* in a slit shape opening across the crosswise direction of the intermediate transfer belt 10. Also, the air knife 596 is provided with an air intake fan 596*b*, and is constituted such that air sucked by the air intake fan 596*b* is blown out from the air blowing out opening 596*a*. The air blowing out opening 596*a* is disposed such that it blows air to the surface of the intermediate transfer belt 10 in the opposite direction with respect to the surface travel direction of the intermediate transfer belt 10. The fixer 92 on the intermediate transfer belt 10 is moved back in a direction opposite to the surface travel direction of the intermediate transfer belt 10 by the air from the air blowing out opening 596*a*, is finally drops downward by gravity, and is collected in a collecting case 596*c* of the air knife 596.

Figure 12:
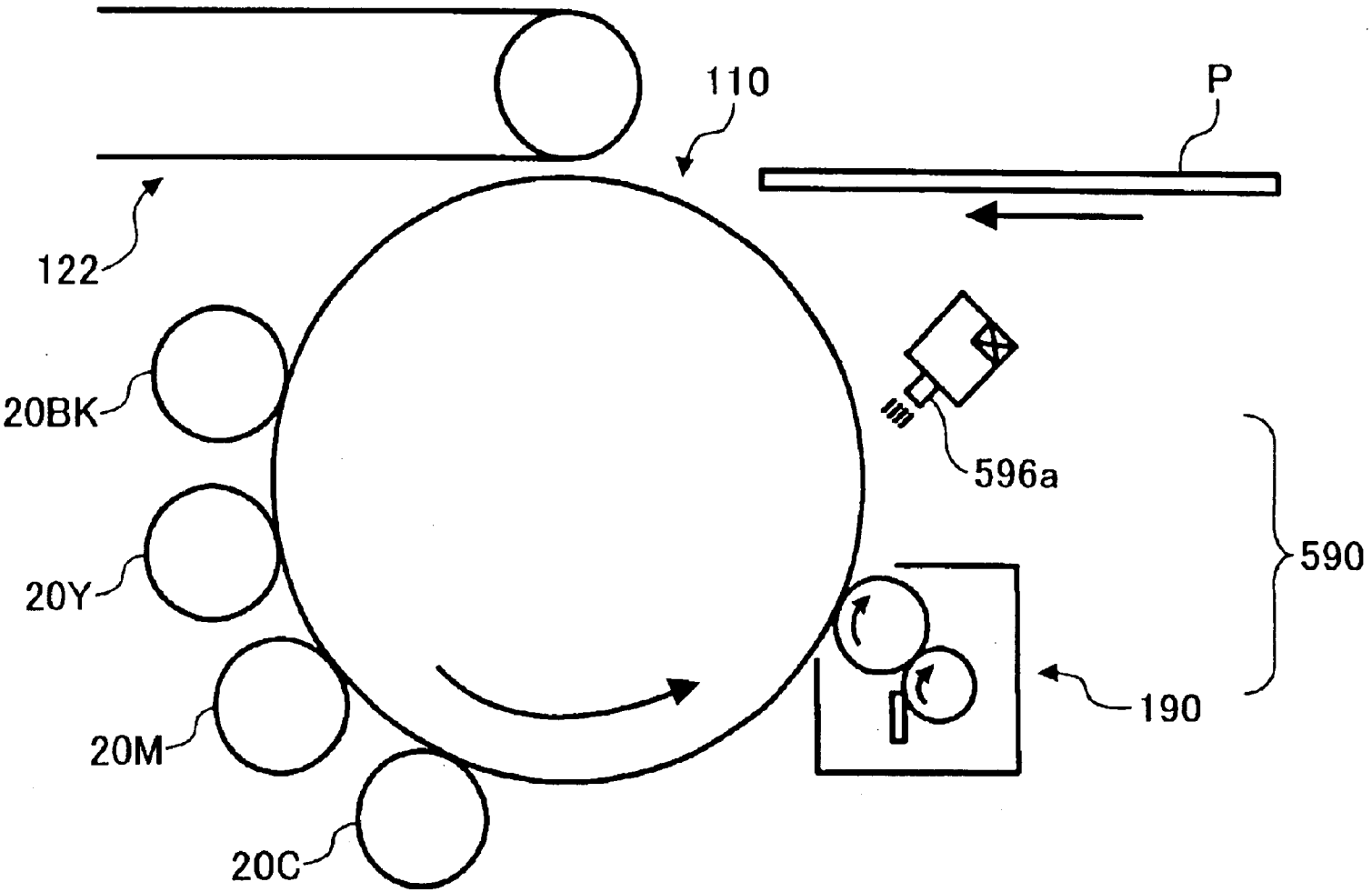
FIG. 12 is a schematic constitution diagram showing another arrangement example of the same fixing apparatus.

Note that in the present constitution example 5, since a part of the intermediate transfer belt 10 is tilted downward in the vertical direction from the fixing apparatus main unit 190 to the air knife 596, though the collecting case 596*c* is provided in the air knife 596, a constitution without the case may be possible. For example, as shown in FIG. 12, a second transfer apparatus 122 is disposed above in the vertical direction with respect to an intermediate transfer drum 110 serving as the toner carrying body. Then, by disposing the fixing apparatus main unit 190 and the air knife 596 as shown in the drawing, it is possible to constitute such that a part of the intermediate transfer belt 10 is tilted upward in the vertical direction from the fixing apparatus main unit 190 to the air knife 596. With this constitution, it is possible to use air from the air blowing out opening 596*a* to move the unnecessary fixer 92 back to the liquid supplying position, and to collect the fixer 92 in the fixing apparatus main unit 190.

As described above, with the present constitution example 5, the fixer 92, which is no longer necessary for the fixing, can be removed before the toner T on the intermediate transfer belt 10 is second-transferred on the transfer paper P as in the constitution example 4. Thus, it is possible to further reduce the quantity of the fixer 92 attached to the transfer paper P, and to further restrain the generation of the curls and the wrinkles of the transfer paper P. Additionally, as in the case with the constitution example 4, it is possible to efficiently restrain the curls and the wrinkles of the transfer paper P which may occur due to the secular degradation of the water repelling property of the intermediate transfer belt 10.

Especially, in the present constitution example 5, since the unnecessary fixer 92 is removed by air, the external force applied to the toner T is reduced compared with the case where the excessive liquid collecting roller 496*a* is brought into contact as in the constitution example 4. Thus, using the processing for removing the unnecessary fixer 92, it is possible to restrain the toner image formed by the toner T carried on the intermediate transfer belt 10 from being disturbed.

CONSTITUTION EXAMPLE 6

The following section describes another constitution example (referred to as "constitution example 6" hereinafter) of the fixing apparatus according to the embodiment 1 described above.

The toner T to which the fixer 92 is attached changes into the film state on the intermediate transfer belt 10 as shown in FIG. 5D as a result of reacting with the fixer 92, and comes to have viscosity. In addition, it is known that this reaction is promoted by heating. Thus, in the present constitution example 6, a specific example where a mechanism for heating the fixer 92 attached to the toner on the intermediate transfer belt 10 is added is described.

Figure 13:
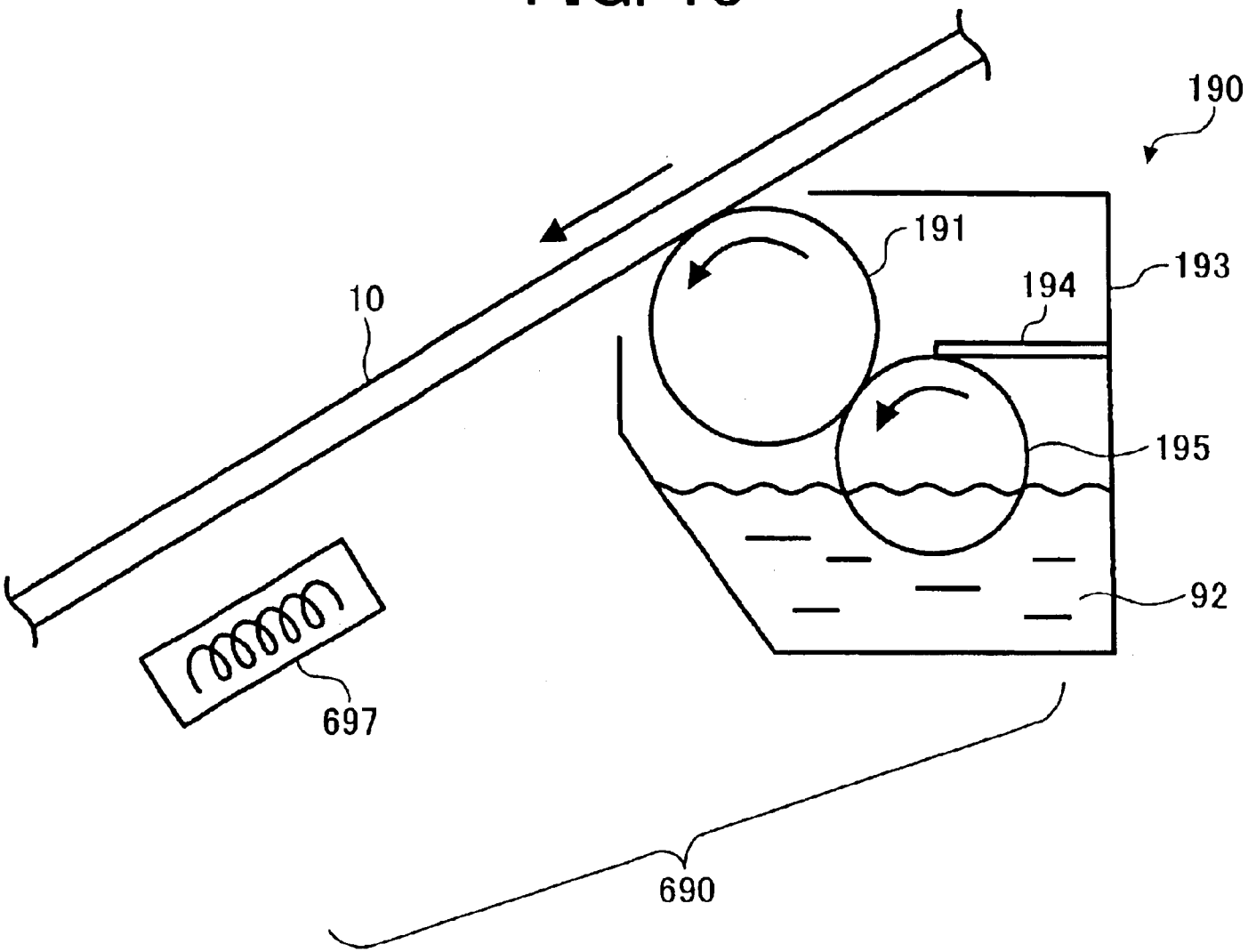
FIG. 13 is a schematic constitution diagram showing a fixing apparatus according to a constitution example 6.

FIG. 13 is a schematic constitution diagram showing a fixing apparatus 690 of the present constitution example 6. Though the main unit of the fixing apparatus 690 has a constitution the same as the fixing apparatus 190 in the constitution example 1 shown in FIG. 6, a heater 697 as a heating device is provided in the fixing apparatus 690. This heater 697 is disposed such that it opposes to the surface of the intermediate transfer belt 10 between the liquid supplying position and the second transfer unit.

As described above, with the present constitution example 6, by heating the fixer 92 attached to the toner T with the heater 697, the reaction of solving the resin component in the toner T is promoted, thereby increasing the fixing property of the toner T. In addition, as a result of promoting the solving reaction, since it is possible to reduce the length of the portion of the intermediate transfer belt 10 between the liquid supplying position and the second transfer unit, it is possible to reduce the size of the apparatus. Further, since it is also possible to evaporate water in the excessive fixer attached to the toner T by using the heater 697 to heat as in the present constitution example 6, it is possible to further reduce the quantity of the fixer 92 attached to the transfer paper P. Thus, it is possible to further restrain the generation of the curls and the wrinkles of the transfer paper P.

Note that the heater 697 according to the present constitution example 6 may be added to the fixing apparatuses 490 and 590 according to the constitution examples 4 and 5. In this case, it is preferable to dispose the heater 697 on the downstream side in the surface traveling direction of the intermediate transfer belt 10 with respect to the excessive liquid removing device such as the excessive liquid collecting roller 496*a* and the air knife 596. In this case, since it is possible to apply heat in the state where the excessive liquid has been sufficiently removed by the excessive liquid removing device, conduction of the heat to the fixer 92 and the toner T is promoted. As a result, it is possible to more efficiently promote the reaction of solving the resin component of the toner T, and to further restrain the quantity of the fixer 92 attached to the transfer paper P to a smaller quantity.

In addition, it is possible to employ other constitutions in place of the heater 697 according to the present constitution example 6. For example, it is possible to use a hot air supplying apparatus as a hot air supplying device provided with a fan for blowing hot air on the surface of the intermediate transfer belt 10 to which the toner T and the fixer 92 are attached along with the heater 697. In this case, it is possible to more efficiently heat the toner T and the fixer 92 on the intermediate transfer belt 10 compared with the case where the heating device is the heater 697. Especially, this constitution including the heater and the fan can realize a device having the functions of both the excessive liquid removing device and the heating device exemplified in the constitution example 4 and the constitution example 5. As a result, it is possible to reduce the space and the cost of the apparatus.

Figure 14:
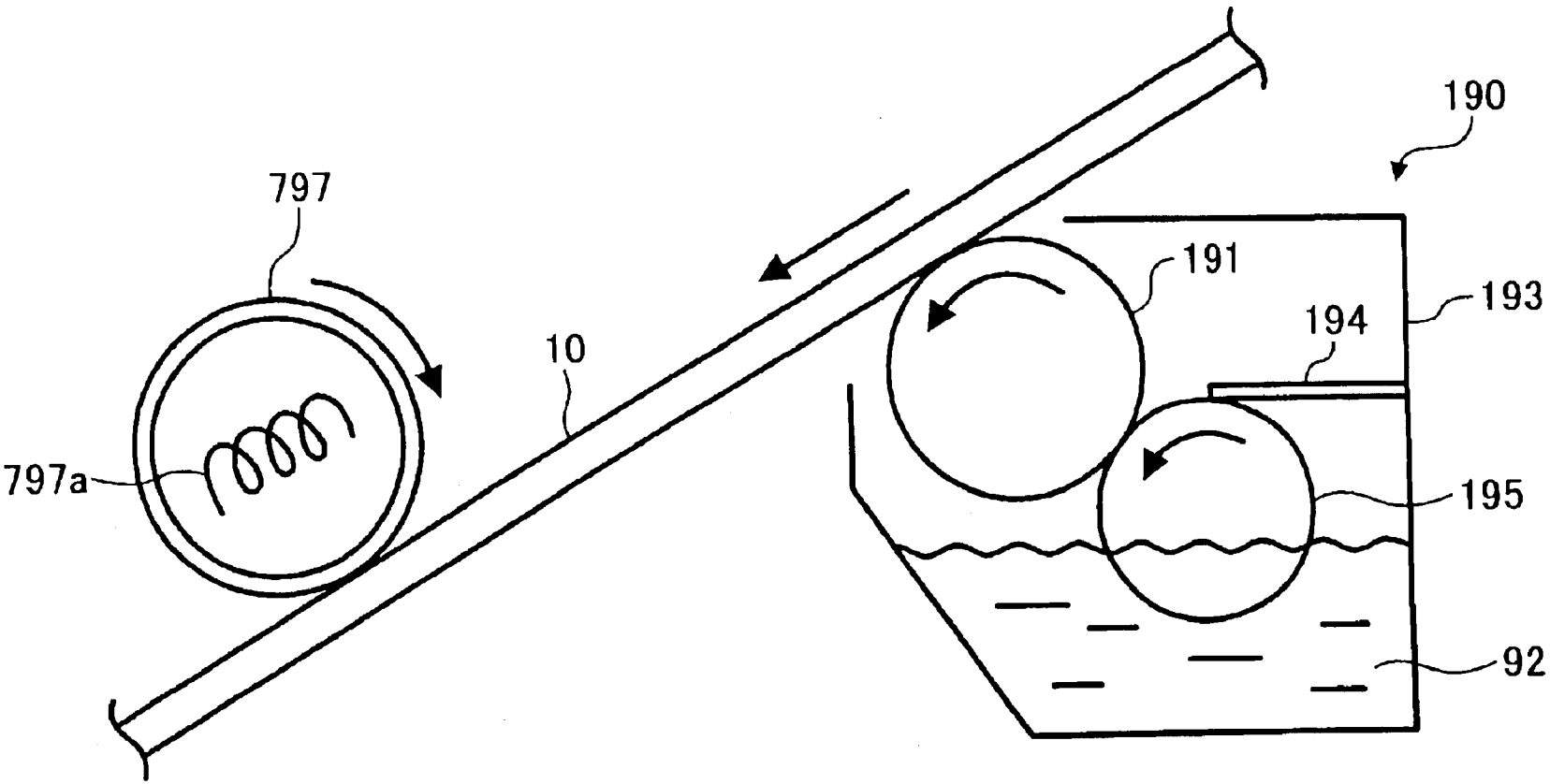
FIG. 14 is a schematic constitution diagram showing another constitution of the same fixing apparatus.

In addition, it is possible to employ a heating device shown in FIG. 14 in place of the heater 697 according to the present constitution example 6. This heating device is a heating roller 797 which is in contact with the reverse surface of the intermediate transfer belt 10. This heating roller 797 is provided with a heater 797*a* inside, and heats the intermediate transfer belt 10 from the reverse surface side. Since the intermediate transfer belt 10 is heated by the heating roller 797, the toner T and the fixer 92 attached on its surface are heated. With this constitution, it is possible to reduce the number of members disposed around the intermediate transfer belt 10, thereby reducing the size of the apparatus.

Embodiment 2

The following section describes another embodiment (the present embodiment is referred to as "embodiment 2" hereinafter) where the present invention is applied to a copying machine as in the embodiment 1. Note that since the base constitution and the image forming operation of the copying machine according to the present embodiment is approximately similar to those in the embodiment 1, the following section describes the fixing process which is different from the embodiment 1.

Figure 15:
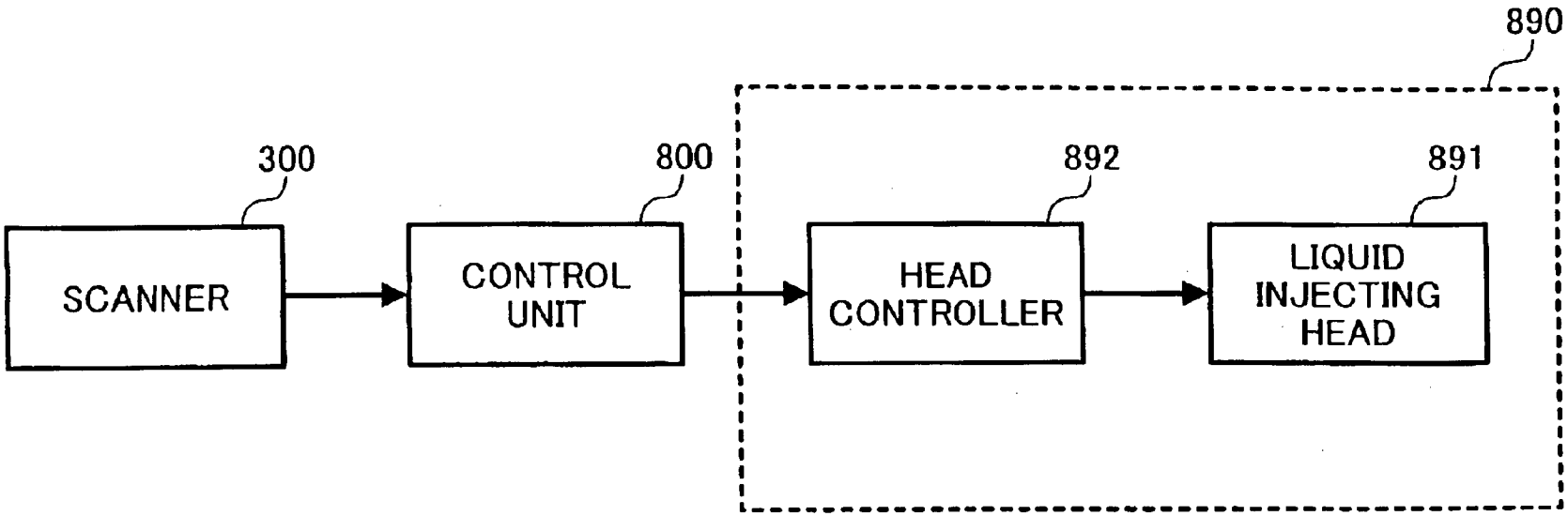
FIG. 15 is a block diagram showing a principal constitution conducting a fixing process of a copying machine according to an embodiment 2.

FIG. 15 is a block diagram showing a principal constitution conducting the fixing process in the present embodiment 2.

The fixing apparatus 890 in the present embodiment 2 is provided with a liquid injecting head 891 having a constitution similar to an ink head employed in an ink jet type image forming apparatus. Note that the liquid injecting head 891 injects the fixer 92 toward the toner T carried on the surface of the intermediate transfer belt 10 under the control of a head controller 892. The head controller 892 is connected with a control unit 800 which controls the entire copying machine, and controls the injection of the fixer 92 with the liquid injecting head 891 according to an instruction from the control unit 800.

As described above, when a user presses a start switch, image information on a document on the contact glass 32 is read by the reading sensor 36 of the scanner 300. When this image information is sent from the scanner 300 to the control unit 800, the control unit 800 controls the individual units based on the image information, thereby conducting image forming operation. In this process, the control unit 800 recognizes dot positions for the individual colors constituting an image to be formed from the image information, and sends the dot information to the exposing apparatus 21, and consequently, the exposing apparatus 21 forms the latent electrostatic images as dots on the individual photoreceptor drums 20Y, 20C, 20M, and 20BK corresponding to the individual colors. The control unit 800 outputs the dot information to be output to the exposing apparatus 21 to the head controller 892 of the fixing apparatus 890 too. As a result, the head controller 892 can recognize the position of the toner T attached to the surface of the intermediate transfer belt 10 as dots. Then, when the surface of the intermediate transfer belt 10 to which the toner T is attached reaches a position opposing to the liquid injecting head 891, the fixer 92 is injected on the toner T on the intermediate transfer belt 10 from the liquid injecting head 891 controlled by the head controller 892. Namely, the fixer 92 injected from the liquid injecting head 891 is attached to parts of the toner T on the intermediate transfer belt 10, and is not attached to surface parts of the intermediate transfer belt 10 which are not carrying the toner T.

As described above, with the present embodiment 2, the fixer 92 on the surface of the intermediate transfer belt 10 is present only on the parts of the toner T. Thus, as is the case with the embodiment 1, compared with the conventional case where fixer is imparted to entire transfer paper, a reduced quantity of the fixer 92 is impregnated into the transfer paper P, and thus, generation of the curls and the wrinkles of the transfer paper P is restrained. In addition with the present embodiment 2, as is the case with the embodiment 1, compared with the conventional case, it is possible to restrain wasteful consumption of the fixer 92, and simultaneously, to eliminate the power conventionally consumed by the mechanism for forcibly drying, thereby saving the energy.

In addition, with the present embodiment 2, there is such advantage that the problem of the curls and the wrinkles of the transfer paper P which may occur due to secular degradation of the water repelling property of the intermediate transfer belt 10 as in the embodiment 1 does not occur.

Note that the constitution of the liquid injecting head 891 used in the present embodiment 2 is not limited to that of the injecting heads employed in the well known inkjet type image forming apparatus as long as the injecting head can inject a minute quantity of fixer 92 required for fixing the toner T for the individual dots on the transfer paper P.

In addition, the excessive liquid removing device exemplified in the constitution example 4 and the constitution example 5 and the heating device exemplified in the constitution example 6 may be added to the copying machine according to the present embodiment 2. If this is the case, effects similar to the effects described for these constitution examples are obtained.

Embodiment 3

The following section describes another embodiment (the present embodiment is referred to as "embodiment 3" hereinafter) where the present invention is applied to a copying machine as in the embodiment 1 and the embodiment 2. Note that since the base constitution and the image forming operation of the copying machine according to the present embodiment is approximately equal to those in the embodiment 1 and the embodiment 2, the following section describes the fixing process which is different from these embodiments.

Figure 16:
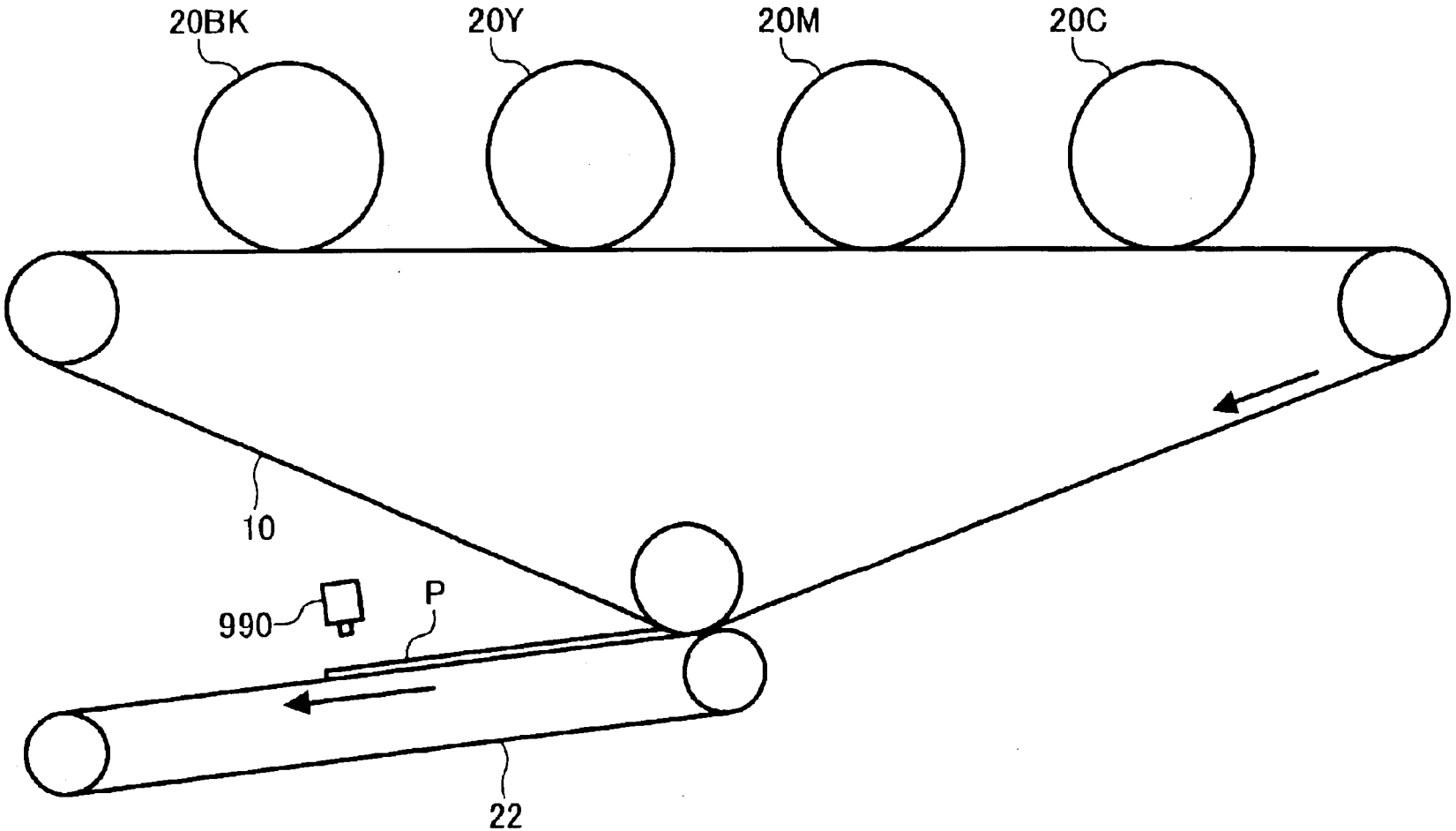
FIG. 16 is a schematic constitution diagram of a part including a fixing apparatus in a copying machine according to an embodiment 3.

FIG. 16 is a schematic constitution diagram of a part including the fixing apparatus of the copying machine according to the present embodiment 3. The fixing apparatus 990 used in the present embodiment 3 has the same constitution as the fixing apparatus 90 used in the embodiment 2. Namely, the fixing apparatus 990 according to the present embodiment 3 also injects the fixer 92 from a liquid injecting head only to the toner T when the apparatus receives the dot information from the control unit 800. However, the fixing apparatus 990 according to the present embodiment 3 is different in that the apparatus injects the fixer 92 to the toner T on the transfer paper P from the embodiment 2 which injects the fixer 92 to the toner T on the intermediate transfer belt 10. Namely, in the present embodiment 3, the fixer 92 is imparted not to the toner T before the second transfer to the transfer paper P, but to the toner T after the second transfer to the transfer paper P.

As described above, with the present embodiment 3, the fixer 92 is imparted only to the parts of the toner T on the transfer paper P, and the fixer is not imparted to the surface of the transfer paper P to which the toner T is not attached.

Thus, as is the case with the embodiment 1 and the embodiment 2, compared with the conventional case where fixer is imparted to entire transfer paper, a reduced quantity of the fixer 92 is impregnated into the transfer paper P, and thus, generation of the curls and the wrinkles of the transfer paper P is restrained. In addition with the present embodiment 3, as is the case with the embodiment 1 and the embodiment 2, compared with the conventional case, it is possible to restrain wasteful consumption of the fixer 92, and simultaneously, to eliminate the power conventionally consumed by the mechanism for forcibly drying, thereby saving the energy.

In addition, with the present embodiment 3, since it is not necessary to apply water repelling treatment on the surface of the intermediate transfer belt 10 as in the embodiment 1 and the embodiment 2, there is also such advantage that the surface material of the intermediate transfer belt 10 is not restricted.

Note that the heating device exemplified in the constitution example 6 may be added to the copying machine according to the present embodiment 3. If this is the case, effects similar to the effects described for the constitution example are obtained.

As described above, the fixing apparatuses 90, 190, 290, 390, 490, 590, 690, 890, and 990 provided for the copying machines according to the individual embodiments impart fixer 92, which solves or swells toner, to the toner T, and then, fix the toner T on the transfer paper P as a recording material. Thus, since the heating process is not necessary which accompanies a large quantity of the power consumption as in the heat fixing method, it is possible to largely save the energy. In addition, in these fixing apparatuses, the fixer 92 is imparted such that the fixer is attached to the toner T, and is not attached to the surface parts of the transfer paper P which are not carrying the toner T. Thus, compared with the conventional case where fixer is imparted to the entire transfer paper P, a reduced quantity of the fixer 92 is impregnated into the transfer paper P, and thus, generation of the curls and the wrinkles of the transfer paper P is restrained. In addition, compared with the conventional case, since the quantity of the fixer 92 consumed per sheet of the transfer paper P is reduced, it is also possible to restrain the wasteful consumption of the fixer 92. Further, as a result of the reduced fixer 92 attached on the transfer paper P, it is possible to realize a constitution where a mechanism which forcibly dries the fixer 92 is not provided. Thus, the electric power consumed by the conventional forcibly-drying mechanism can be eliminated, and further energy saving is realized.

Also, it is possible to employ the constitution example 6 of the embodiment 1 in the embodiment 2, and to use the heating roller 797 as the heating device which heats the intermediate transfer belt 10 from the reverse side of the intermediate transfer belt 10 as described in the section for the constitution example 6. In this case, it is possible to reduce the number of members disposed around the intermediate transfer belt 10, thereby reducing the size of the apparatus.

Also, the heating device described above may be provided for the fixing apparatus 990 according to the embodiment 3. In this case, it is possible to promote the reaction of solving the resin component of the toner T by the fixer 92, thereby increasing the fixing property of the toner T as the constitution example 6 of the embodiment 1. In addition, by promoting the solving reaction, since it is possible to reduce the length of the transport path between the second transfer unit and the paper ejecting unit, it is possible to reduce the size of the apparatus. Additionally, in the individual embodiments, as the fixer 92, the liquid comprising the material which solves or swells the resin component constituting the toner T, and water is used. As a result, it is possible to provide an environment-conscious apparatus compared with a case where volatile organic compound (VOC) such as toluene is used as the fixer.

Though, in the individual embodiments, as the fixer, the liquid comprising the material which solves or swells the resin component constituting the toner T, and water is used, the fixer is not limited to this type, and all well known types of fixer may be used.

Though the description is provided while the color copying machine using the intermediate transfer body is exemplified in the individual embodiments, these embodiments are not limited to the intermediate transfer body, and different variations are possible. For example, an intermediate transfer body in a drum shape or a roller shape may be used in place of the intermediate transfer belt 10. Also, a so-called single drum type image forming apparatus where toner images in the individual colors are sequentially formed on a single latent image carrying body, and then, they are sequentially transferred on an intermediate transfer body to form a color image may be used.

Additionally, an apparatus where the transfer is directly conducted from the latent image carrying body such as a photoreceptor drum to the transfer paper P without using an intermediate transfer body may be used. In this case, such a constitution that fixer is supplied on toner on the latent image carrying body may be used.

Since it is possible to reduce the quantity of the fixer impregnated into the recording material compared with the conventional case where the fixer is imparted to the entire recording material, the excellent effect of restraining the generation of the curls and the wrinkles of the recording material is provided even if the wet fixing method is employed for energy saving.

What is claimed is:

1. A fixing apparatus for imparting a fixer which solves or swells a toner to the toner to fix the toner on a recording material, said apparatus comprising:

a fixer supplying device for imparting to said fixer such that said fixer is attached to said toner, and is not attached to a surface part of said recording material without carrying said toner.

2. The fixing apparatus as claimed in claim 1, wherein said fixer is imparted such that said fixer is attached to the toner on a toner image carrying body which holds a toner image before the toner image is transferred to said recording material, and is not attached to a surface part of said toner image carrying body without carrying said toner, thereby transferring said toner to which said fixer is imparted on said recording material.

3. The fixing apparatus as claimed in claim 2, wherein said fixer supplying device supplies said fixer to the toner carried by the surface of said toner image carrying body based on a position information indicating a toner carrying position on the surface of said toner image carrying body.

4. The fixing apparatus as claimed in claim 2, wherein an action of solving or swelling said toner is promoted by heating said fixer; and a heating device for heating said fixer attached to said toner on said toner image carrying body is provided.

5. The fixing apparatus as claimed in claim 4, wherein said heating device comprises a hot air supplying device for blowing hot air onto the surface of said toner image carrying body.

6. The fixing apparatus as claimed in claim 4, wherein said heating device heats said toner image carrying body from a reverse surface side of said toner image carrying body.

7. The fixing apparatus as claimed in claim 1, wherein said fixer is imparted to the toner carried on said recording material.

8. The fixing apparatus as claimed in claim 7, wherein said fixer supplying device supplies said fixer to the toner carried on said recording material based on a position information indicating a toner carrying position on said recording material.

9. The fixing apparatus as claimed in claim 7, wherein an action of solving or swelling said toner is promoted by heating said fixer, and a heating device for heating the toner on said recording material to which said fixer is imparted.

10. The fixing apparatus as claimed in claim 1, wherein said fixer supplying device supplies a fixer in a foam state onto the surface of said toner image carrying body.

11. The fixing apparatus as claimed in claim 1, wherein said fixer contains a surface active agent.

12. The fixing apparatus as claimed in claim 1, wherein said fixer supplying device supplies a fixer in an atomized state onto the surface of said toner image carrying body.

13. The fixing apparatus as claimed in claim 1, wherein said fixer comprises liquid which contains a material for solving or swelling a resin component constituting said toner, and water.

14. An image forming apparatus comprising:

a toner image carrying body;

a transferring device for transferring toner on said toner image carrying body onto a recording material;

a fixing device for fixing said toner image transferred onto said recording material; and a fixing apparatus for imparting fixer which solves or swells a toner to said toner so as to fix said toner on said recording material, wherein said fixing apparatus is provided with a fixer supplying device for imparting said fixer such that said fixer is attached to said toner, and is not attached to a surface part of said recording material without carrying said toner.

15. An image forming apparatus comprising:

a toner image carrying body;

a transferring device for transferring a toner on said toner image carrying body onto a recording material; and a fixing device for fixing said toner image transferred onto said recording material, wherein a liquid repelling treatment is applied to said toner image carrying body such that a surface of said toner image carrying body has a liquid repelling property against said fixer; and a fixer supplying device for supplying a fixer on the surface of said toner image carrying body carrying said toner image before said toner image on said toner image carrying body is transferred onto said recording material is provided.

16. The image forming apparatus as claimed in claim 15, wherein said fixer supplying device comprises:

a supplying roller provided in contact with the surface of said toner image carrying body or in separation by a predetermined gap from the surfaces of said toner image carrying body while opposing to the surface of said toner image carrying body; and an applying roller in contact with a surface of said supplying roller for applying said fixer on the surface, and the fixer contained inside a uniformly-patterned groove formed on the surface of said applying roller is applied on the surface of said supplying roller.

17. The image forming apparatus as claimed in claim 15, wherein said fixer supplying device supplies a fixer in a foam state onto the surface of the toner image carrying body.

18. The image forming apparatus as claimed in claim 17, wherein said fixer contains a surface active agent.

19. The image forming apparatus as claimed in claim 15, wherein said fixer supplying device supplies fixer in an atomized state onto the surface of said toner image carrying body.

20. The image forming apparatus as claimed in claim 15, wherein an excessive liquid removing device for removing an excess of the fixer supplied on the surface of said toner image carrying body before said toner image on said toner image carrying body is transferred onto said recording material is provided.

21. The image forming apparatus as claimed in claim 20, wherein said excessive liquid removing device comprises an air supplying device which blows air onto the surface of said toner image carrying body so as to remove said excess.

22. The image forming apparatus as claimed in claim 20, wherein said excessive liquid removing device includes a collecting roller which is provided in contact with the surface of said toner image carrying body or in separation by a predetermined gap from the surfaces of said toner image carrying body while opposing to the surface of said toner image carrying body, and attaches said excess on a surface for collecting said excess.

23. The image forming apparatus as claimed in claim 15, wherein an action of solving or swelling said toner is promoted by heating said fixer, and a heating device for heating said fixer attached to said toner on said toner image carrying body is provided.

24. The image forming apparatus as claimed in claim 23, wherein said heating device comprises a hot air supplying device for blowing hot air onto the surface of said toner image carrying body.

25. The image fanning apparatus as claimed in claim 23, wherein said heating device heats said toner image carrying body from the reverse surface side of said toner image carrying body.

26. The image forming apparatus as claimed in claim 15, wherein said fixer comprises liquid which contains a material for solving or swelling a resin component constituting said toner, and water.

27. The image forming apparatus as claimed in claim 15, wherein said fixing apparatus comprises a liquid injecting head for injecting said fixer only on said toner.

28. The image forming apparatus as claimed in claim 15, wherein said fixer is imparted to said toner which is not before second-transfer on said recording material, but which is after the second-transfer on said recording material.

* * * * *